US005724935A

United States Patent [19]

Routery

[11] Patent Number: 5,724,935

[45] Date of Patent: Mar. 10, 1998

[54] RECIPROCATING PISTON ASSEMBLY

[76] Inventor: Edward E. Routery, 6209 E. McKellips, Mesa, Ariz. 85205

[21] Appl. No.: 584,133

[22] Filed: Jan. 11, 1996

[51] Int. Cl.[6] ..... F02B 75/06

[52] U.S. Cl. ..... 123/197.4; 123/48 B; 123/78 E

[58] Field of Search ..... 123/48 B, 78 F, 123/197.4, 78 E, 78 BA, 197.3

[56] References Cited

U.S. PATENT DOCUMENTS

| | | | |
|---|---|---|---|
| 1,987,661 | 1/1935 | Blauvelt et al. | 123/48 B |
| 2,433,639 | 12/1947 | Woodruff et al. | 123/48 B |
| 3,703,839 | 11/1972 | Velinde | 123/48 B |
| 3,861,239 | 1/1975 | McWhorter | 123/48 B |
| 4,240,386 | 12/1980 | Crist | 123/48 B |
| 4,738,230 | 4/1988 | Johnson | 123/48 B |
| 5,136,987 | 8/1992 | Schechter et al. | 123/48 B |
| 5,146,879 | 9/1992 | Kume et al. | 123/48 B |
| 5,156,121 | 10/1992 | Routery | 123/197.3 |
| 5,163,386 | 11/1992 | Schechter | 123/48 B |
| 5,165,368 | 11/1992 | Schechter | 123/48 B |
| 5,201,287 | 4/1993 | Blish | 123/48 B |
| 5,335,632 | 8/1994 | Hefley | 123/78 E |
| 5,406,911 | 4/1995 | Hefley | 123/48 B |

*Primary Examiner*—David A. Okonsky
*Attorney, Agent, or Firm*—Tod R. Nissle, P.C.

[57] ABSTRACT

An improved piston-cylinder internal combustion engine alters the volume of the combustion chamber without relying on movement of the piston to change the volume of the combustion chamber.

4 Claims, 18 Drawing Sheets

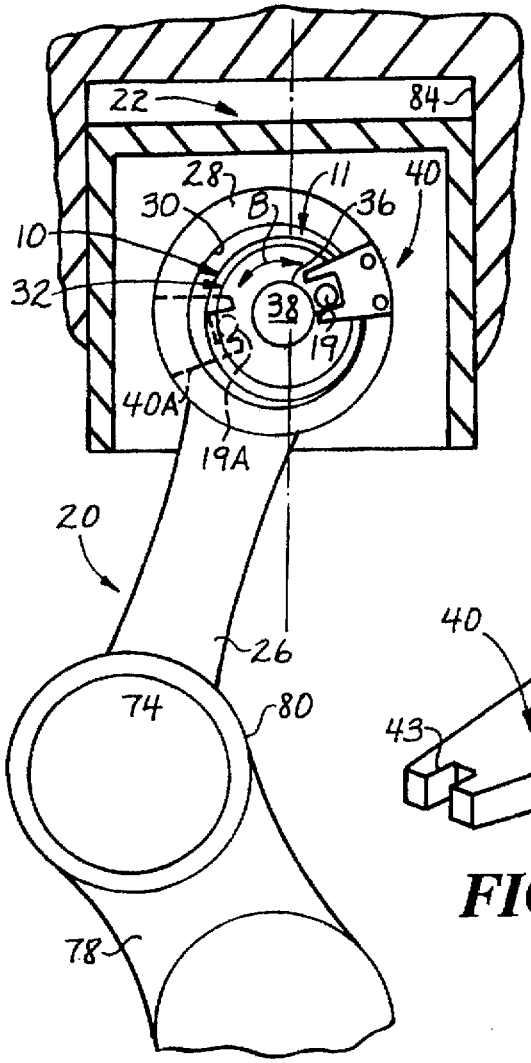
FIG. 4
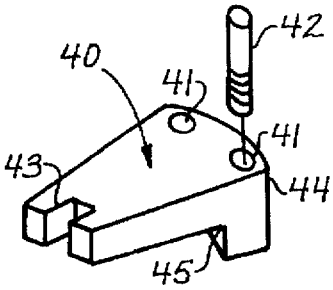
FIG. 6
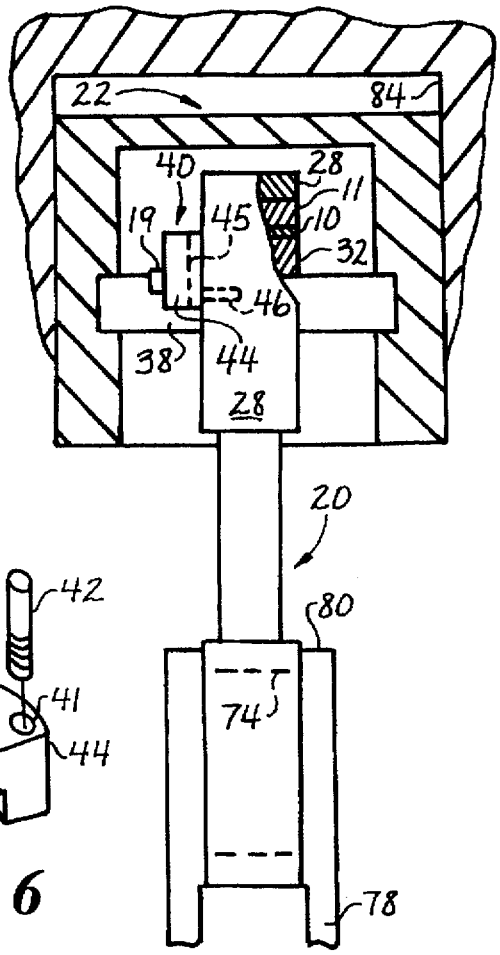
FIG. 5
FIG. 7
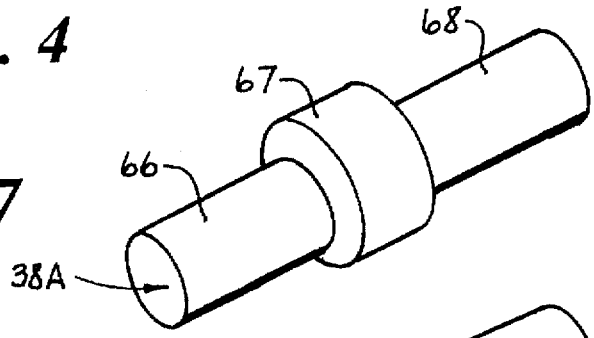
FIG. 8
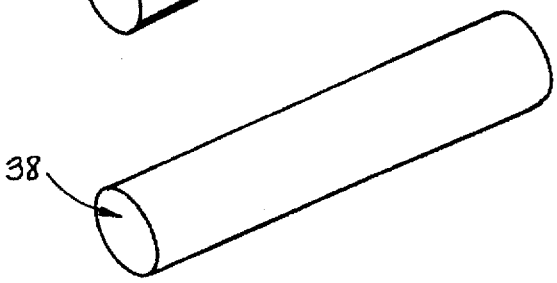

FIG. 33A
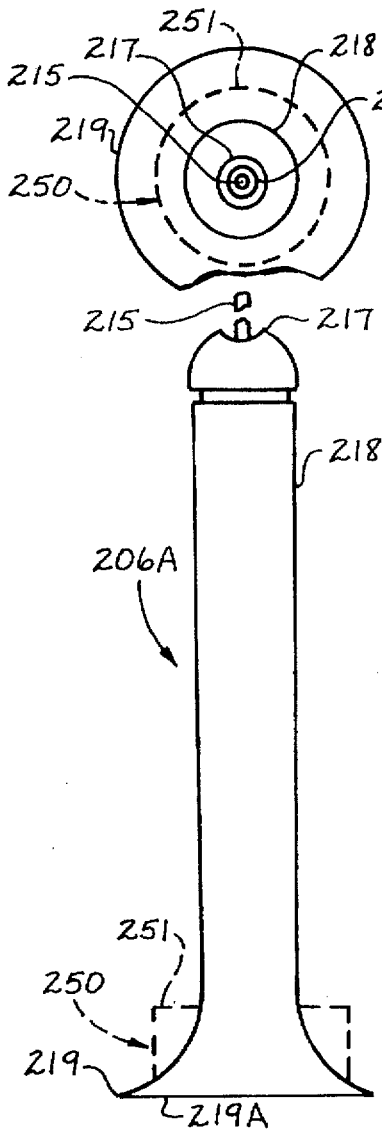
FIG. 33
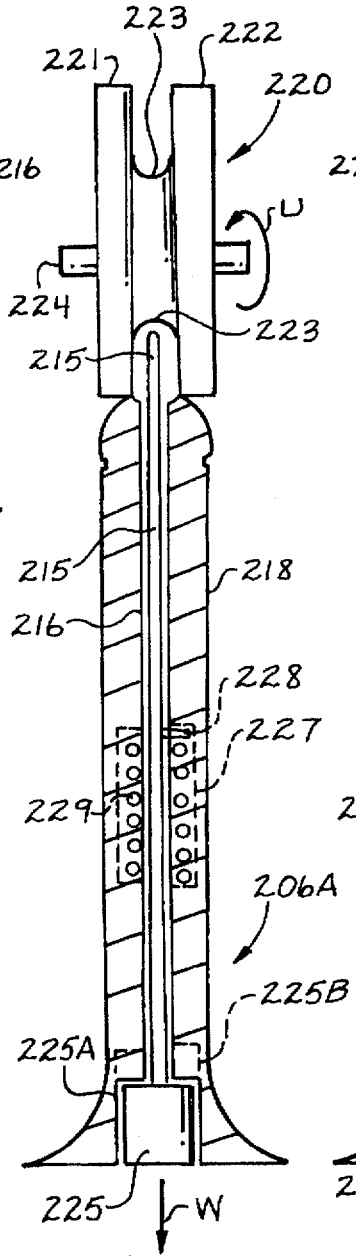
FIG. 34
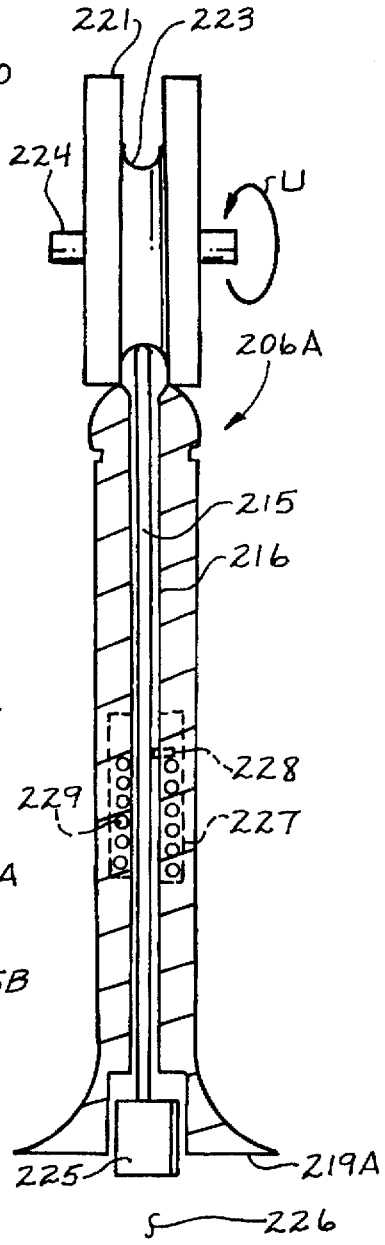
FIG. 35

RECIPROCATING PISTON ASSEMBLY

This invention relates to a reciprocating piston assembly in an internal combustion engine, Stirling engine, compressor, pump or other source of motive power.

In a conventional internal combustion engine, the piston is stationary for only a short period of time when the piston is at top dead center (TDC) in the cylinder. Fuel injected into the cylinder while the piston approaches TDC will not completely combust during this short period of time. A residual uncombusted portion of fuel remains. This residual portion burns while the piston moves downward from TDC. In comparison to the fuel burned while the piston is at TDC, the combustion of the residual portion of fuel produces less mechanical work, produces more waste heat, and reduces the efficiency of the engine. In addition, some of the residual portion of fuel may not completely burn, resulting in higher concentrations of hydrocarbons, carbon monoxide and other undesirable pollutants in the exhaust gas discharged from the cylinder.

The piston connecting rod assembly disclosed in my prior U.S. Pat. No. 5,245,962 for "VARIABLE LENGTH CONNECTING ROD FOR INTERNAL COMBUSTION ENGINE" provides for controlled volume combustion (CVC) by momentarily retarding the movement of the piston to increase the period of time during which the piston is at TDC. Controlled volume combustion occurs when the entire fuel-air mixture injected into a cylinder above the piston in the cylinder burns before the piston makes any substantial movement downward from its top dead center (TDC) position.

The apparatus described in my above-identified United States Letters Patent achieves controlled volume combustion by utilizing a linkage assembly which interconnects the piston rod and an eccentric connected to the piston. Although this linkage assembly extends the time during which a piston is at TDC and therefore improves the efficiency of combustion of fuel, it has functional limitations.

One limitation of the prior art linkage assembly is that the operation of the linkage assembly is directly dependent on and is activated by a change in the angular relation between the piston rod and the piston.

A second limitation of the prior art linkage assembly is that the movement of the piston is always altered at the same places, TDC and bottom dead center (BDC). It would be advantageous of the speed of travel of the piston could be temporarily retarded or advanced at any point along the path of travel of the piston to compensate for changes in humidity, air-fuel ratio, etc.

A third limitation of the prior art linkage assembly is that the amount by which the speed of travel of the piston is altered is constant, and is not adjustable. It would be advantageous of the amount by which the piston is retarded or advanced could be varied depending on the humidity, fuel quality, type of engine, etc.

A fourth limitation of the prior art linkage assembly is that during the stroke of a piston the incremental amounts by which the volume of the combustion space above the piston is altered during each position of the piston are constant, and are not adjustable. It would be advantageous if the volume of the combustion space for a given position of the piston could be varied depending on the humidity, fuel quality, type of engine, etc.

Accordingly, it would be highly desirable to provide an improved reciprocating piston assembly for a prime mover which would enable the speed of travel of the piston or the volume of the combustion space to be momentarily increased or decreased any point along the path of travel of the piston.

It would also be highly desirable to provide an improved reciprocating piston assembly which would enable the speed of travel of the piston or the volume of the combustion space to be adjusted independently of the angular relationship between the piston and piston rod.

Further, it would be highly desirable to provide an improved reciprocating piston assembly which would enable the amount by which the speed of travel of the piston or the volume of the combustion space is altered to be varied.

Therefore, it is a principal object of the invention to provide an improved reciprocating piston assembly for a source of motive power.

A further object of the invention is to provide a reciprocating piston assembly which permits the speed of travel of the piston or the volume of the combustion space to be adjusted linearly or non-linearly by variable amounts at any point along the path of travel of the piston.

Another object of the invention is to provide a reciprocating piston assembly which permits the speed of travel of the piston or the volume of the combustion space to be increased or decreased independently of the piston rod.

These and other, further and more specific objects and advantages of the invention will be apparent to those skilled in the art from the following detailed description thereof, taken in conjunction with the drawings, in which:

FIG. 4 is a section side view illustrating an alternate embodiment of the invention;

FIG. 5 is a side section view further illustrating the piston and connecting rod of FIG. 4;

FIG. 6 is a perspective view illustrating a linkage element in the piston of FIG. 4;

FIG. 7 is perspective view illustrating a wrist pin used in another embodiment of the invention;

FIG. 8 is a perspective view illustrating a conventional cylindrical wrist pin of the type utilized in the apparatus of FIGS. 1, 2, 4, 5, 9, and 10;

FIG. 33 is a side view illustrating an internal combustion engine valve constructed in accordance with the principles of the invention;

FIG. 34 is a side section view of the valve of FIG. 33 illustrating further internal construction details thereof;

FIG. 35 is a side section view of the valve of FIG. 33 illustrating the mode of operation thereof;

Briefly, in accordance with my invention, I provide an improved reciprocating piston apparatus. The apparatus includes a cylinder; a piston positioned in and operatively associated with the cylinder to define a combustion chamber and to reciprocate through a plurality of positions in the cylinder. The combustion chamber has a specific shape, dimension, and volume for each of the plurality of positions of the piston in the cylinder, and has a volume which changes when the piston moves from one of the plurality of positions to another of the plurality of positions. The piston apparatus also includes a crankshaft and a connecting rod. The connecting rod includes a first end connected to the piston and a second end connected to the crankshaft. The crankshaft moves the piston and the connecting rod between a distal substantially motionless position and a proximate substantially motionless position such that the piston reciprocates in the cylinder in two opposing directions of travel and through the plurality of positions of the piston. The piston apparatus also includes volume alteration apparatus to alter said specific shape, dimension, and volume of the combustion chamber when the piston is in at least one of the plurality of positions of the piston.

In another embodiment of the invention, I provide a method for altering the combustion space in a reciprocating piston apparatus. The piston apparatus includes a cylinder and a piston positioned in and operatively associated with the cylinder to define a combustion chamber and to reciprocate through a plurality of positions in the cylinder. The combustion chamber has a specific shape, dimension, and volume for each of the plurality of positions of said piston in said cylinder, and has a volume which changes when the piston moves from one of the plurality of positions to another of the plurality of positions. The piston apparatus also includes a crankshaft and a connecting rod. The connecting rod has a first end connected to the piston and a second end connected to the crankshaft. The crankshaft moves the piston and the connecting rod between a distal substantially motionless position and a proximate substantially motionless position such that the piston reciprocates in the cylinder in two opposing directions of travel and through the plurality of positions of the piston in the cylinder. The method comprises the step of altering the shape, dimension, and volume of the combustion chamber when the piston is in at least one of the plurality of positions of the piston in the cylinder.

Figure 1:
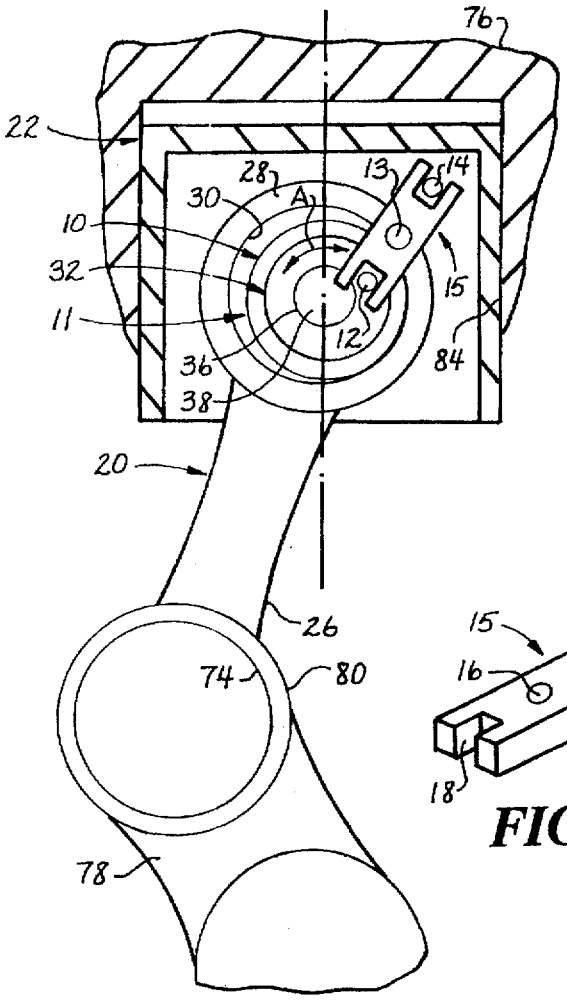
FIG. 1 is a sectional side view illustrating a piston and connecting rod constructed in accordance with the principles of the invention.
Figure 2:
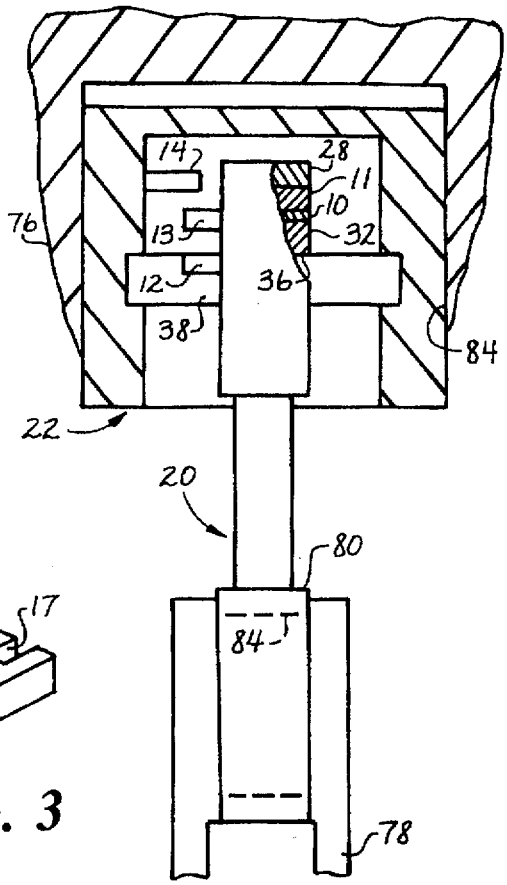
FIG. 2 is a side section view further illustrating the apparatus of FIG. 1.

Turning now to the drawings, which depict the presently preferred embodiments of the invention for the purpose of illustrating the practice thereof and not by way of limitation, and in which like reference characters refer to corresponding elements throughout the several views, FIGS. 1 and 2 illustrate a connecting rod assembly 20 for connecting a crank shaft 78 and a conventional piston 22 arranged to reciprocate in a cylinder 84 in a conventional two-stroke or four-stroke internal combustion engine 76. Alternatively; the connecting rod assembly may be employed in a compressor, pump, or other source of motive power.

The connecting rod assembly 20 includes a unitary forged connecting rod 26 having an upper end 28 defining a cylindrical sleeve 30. A cylindrical disk 32 is rotatably received with the sleeve 30. A cylindrical needle bearing 10 is fixedly secured to the circumference of disk 32. A tapered member 11 having the appearance in FIG. 1 of the waning crescent moon is slidably interposed between bearing 10 and sleeve 30. The disk 32 defines a wrist pin bore 36 offset from and parallel to the central axis equidistant from all points on sleeve 30, passing entirely through the disk 32 to closely and rotatably receive a wrist pin 38. Pin 38 is rigidly mounted with the piston 22 as shown in FIG. 2.

Pin 12 is attached to disk 38. Pin 13 is attached to end 28. Pin 14 is attached to the inside of piston 12. H-shaped link 15 (FIG. 3) is mounted on pins 12 to 14 in the manner illustrated in FIG. 1 such that pin 13 slidably extends through cylindrical aperture 16, U-shaped aperture 17 houses and contacts pin 14, and U-shaped aperture 18 houses and contacts pin 12. Aperture 16 extends completely through link 15, as do apertures 17 and 18. Link 15 has been omitted from FIG. 2 for the sake of clarity.

In operation of the apparatus of FIGS. 1 and 2, when the crankshaft 68 rotates and moves rod 26, upper end 28 and pin 13 move. When pin 13 moves, link 15 pivots around pin 13 and fixed pin 14 to displace pin 12 and rotate disk 32 in the directions indicated by arrows A. Bearing 10 is attached to and rotates simultaneously with disk 32. Member 11 slides intermediate sleeve 30 and bearing 10. The rotation of disk 32 and its bearing 10 in the directions indicated by arrows A advances or retards the movement of piston 22 to alter the speed at which the piston 22 is normally moved by the crankshaft at a selected point along the piston's path of travel when the crankshaft is turning at a selected RPM.

In FIG. 1, the wrist pin 38 is centered in the piston 22. As would be appreciated by those of skill in the art, the position of pin 38 in piston 22 can be moved off-center by maintaining the longitudinal axis of pin 38 in the horizontal orientation of FIG. 2 and by also moving the pin 38 to the right or left in piston 22 in FIG. 1 and then rigidly attached pin 38 to piston 22. The position of pin 12 on disk 32, of pin 13 on end 28, and of pin 14 on piston 22 can, along with shape of link 15, also be altered to produce the desired advancing or retarding of the movement of piston 22 during its reciprocal travel in cylinder 84. The connecting rod 26 defines at its lower end 80 a crank sleeve 74 sized to rotatably receive an orbiting portion of the crank 78.

Figure 3:
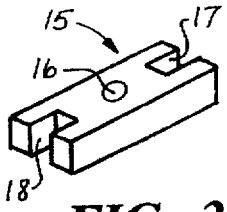
FIG. 3 is a perspective view illustrating a linkage element in the piston of FIG. 1.

An alternate embodiment of the invention is illustrated in FIGS. 4 to 6 and is identical to the apparatus of FIGS. 1 to 3 except that the pins 12, 13, 14 and link 15 of FIGS. 1 to 3 have been removed and replaced by pin 19 and link 40. Pin 19 is attached to disk 32. Link 40 includes U-shaped slot 43 which slidably, rotatably receives pin 19. Link 40 is attached to upper end 28 by screws 42 which pass through apertures 41 and turn into internally threaded openings 46 formed in upper end 28.

In FIGS. 4 and 5, the wrist pin 38 is centered in piston 22. The position of pin 38 in piston 22 in the apparatus of FIGS. 4 and 5 can be moved off-center by maintaining the longitudinal axis of pin 38 in the horizontal orientation of FIG. 5 and by also moving the pin 38 to the right or left in piston 22 in FIG. 4 and then rigidly attached pin 38 to piston 22. The position of pin 19 on disk 32 and of link 40 on end 28 be altered to produce the desired advancing or retarding of the movement of piston 22 during its reciprocal travel in cylinder 84. For example, pin 19 can be moved to the position on disk 32 indicated by dashed lines 19A while the link 40 can be moved to the position on end 28 indicated by dashed lines 40A in FIG. 4. The shape and dimension of pin 19 and link 40 can also be altered as desired.

In operation of the apparatus of FIGS. 4 and 5, when the crankshaft 68 rotates and moves rod 26, upper end 28 and link 40 move. When link 40 moves, it displaces pin 19 and causes disk 32 to rotate in one of the directions indicated by arrows B in FIG. 4. Bearing 10 is attached to and rotates simultaneously with disk 32. Member 11 slides intermediate sleeve 30 and bearing 10. The rotation of disk 32 and its bearing 10 in the directions indicated by arrows B advances or retards the movement of piston 22 to alter the speed at which the piston 22 is normally moved by the crankshaft at a selected point along the piston's path of travel when the crankshaft is turning at a selected RPM.

Figures 9, 10:
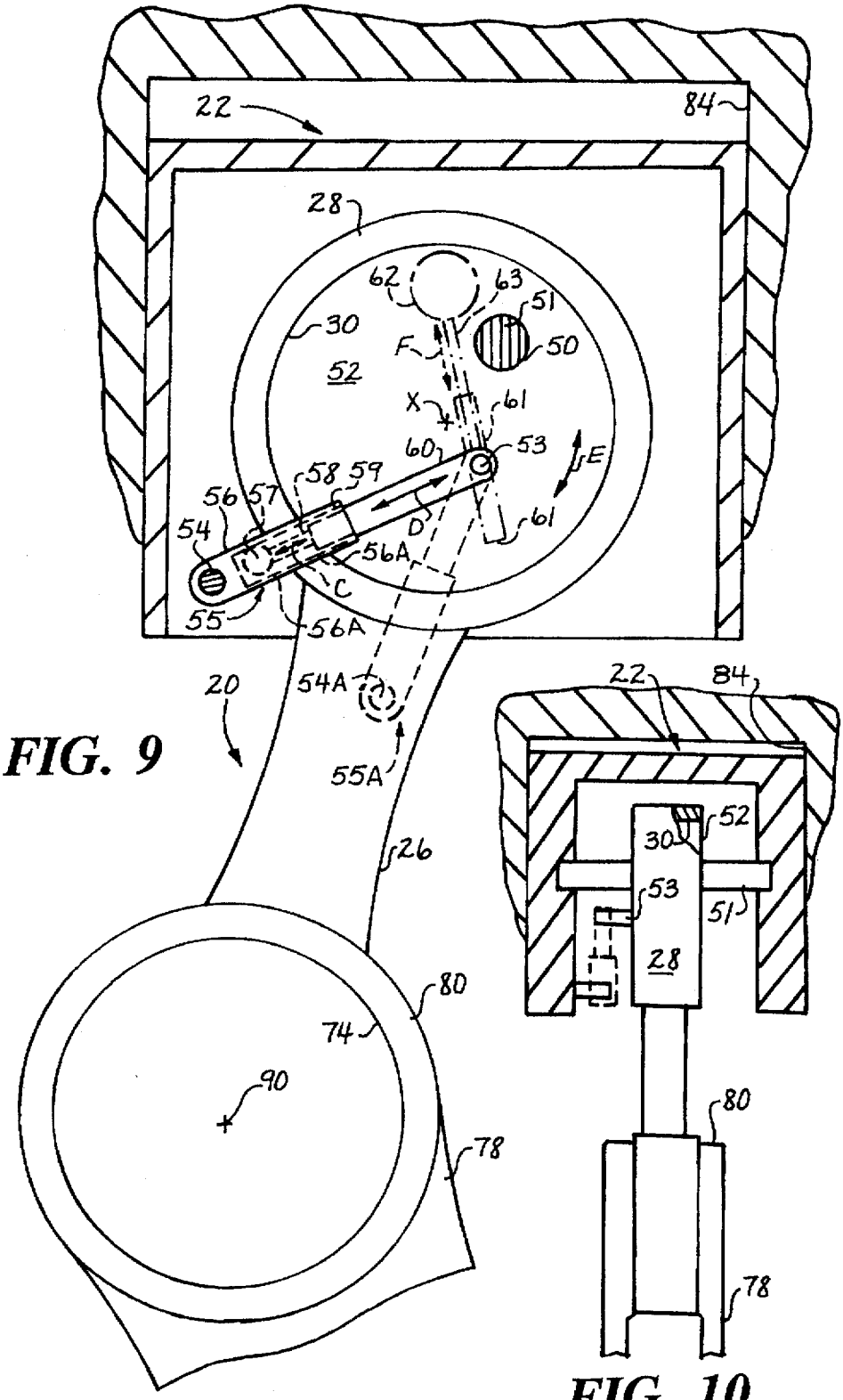
FIG. 9 is a side section view illustrating still another embodiment of the invention.
FIG. 10 is a side section view further illustrating the piston and connecting rod apparatus of FIG. 9.

An alternate embodiment of the invention is illustrated in FIGS. 9 and 10 and is similar to the apparatus of FIGS. 1 to 3 in that it includes a connecting rod 26 with an upper end 28 and a lower end 80 with crank sleeve 74 sized to rotatably receive an orbiting portion of the crank 78. Upper end 28 defines a cylindrical sleeve 30 which rotatably receives disk 52. The disk 52 defines a wrist pin bore 50 offset from and parallel to the central axis X of disk 52. Axis X is equidistant from all points on sleeve 30. Cylindrical bore 50 passes entirely through the disk 52 to closely and rotatably receive a wrist pin 51. Pin 51 is rigidly mounted with the piston 22 as shown in FIG. 10.

Pin 53 is attached to disk 52, and pin 54 is attached to disk 22. Telescoping unit 55 extends between and interconnects pins 53 and 54. Unit 55 includes hollow cylindrical base 56 pivotally mounted on pin 54 and includes neck 60 slidably received by cylindrical opening 59 of base 55. Arm 58 interconnects motor 57 and neck 60. Motor 57 is inside and attached to opening 59. Motor 57 moves arm 58 in the directions indicated by arrows C to retract and extend neck 60 in the directions indicated by arrows D to alter the length of unit 55. If desired, motor 57 can include a receiver which permits the motor to be turned on and off by signals produced by a transmitter which is remote from the motor 57. Further, a solenoid apparatus, spring system, or any other desired means can be utilized to control and/or alter the length of unit 55.

Unit 55 need not comprise a pair of telescoping members. For example, unit 55 can comprise a unitary member 10 including an embedded heat element. When the element is turned on and heat is produced, the length of unit 55 increases. When the heat element is turned off and cools, the length of unit 55 increases. In the practice of the invention, it is only important that unit 55 be able to alter its length to alter the distance between pins 53 and 54. Unit 55 can be secured to rod 26 by pin 54. This arrangement is indicated in FIG. 9 by dashed lines 54A and 55A. In the apparatus of FIGS. 9 and 10, the longitudinal axis of wrist pin 51 preferably is parallel to and spaced apart from the centerline X of cylindrical disk 52.

In operation of the apparatus of FIGS. 9 and 10, when the crankshaft 68 rotates and moves rod 26, piston 22 reciprocates in cylinder 84 in conventional fashion. Reversible motor 57 is activated at any selected point along the path of travel of piston 22. When motor 57 is activated, arm 58 is moved in one of the directions indicated by arrow C, and neck 60 is displaced in one of the directions indicated by arrows D. The amount by which neck 60 is displaced in one of the directions indicated by arrows D varies depending on how long the motor 60 is operated and on the speed at which motor 57 moves neck 60 in one or the other of the directions indicated by arrows D. When neck 60 is displaced, disk 52 rotates about wrist pin 51 in one of the directions indicated by arrows E. The rotation of disk 52 in one of the directions indicated by arrows E in FIG. 9 advances or retards the movement of piston 22 to alter the speed at which the piston 22 is normally moved by the crankshaft at a selected point along the piston's path of travel when the crankshaft is turning at a selected RPM.

If desired, a slot, indicated by dashed lines 61 in FIG. 9, can be formed in disk 52. Slot 61 slidably receives pin 53. An arm 63 can interconnect a motor 62 and the pin 53. Motor 62 is mounted on disk 52 in FIG. 9 but can also be mounted on piston 22 or rod 26. Motor 62 extends or retracts arm 63 in the directions indicated by arrows F to move pin 53 along slot 53. When pin 53 is moved along slot 61 and the length of unit 55 is constant (or is, in certain cases, altered), disk 52 is rotated and the movement of piston 22 is advanced or retarded. The amount by which arm 63 is advanced or retarded in one or the other of the directions indicated by arrows F varies depending on how long and at what speed motor 62 is operated.

Figures 11, 12:
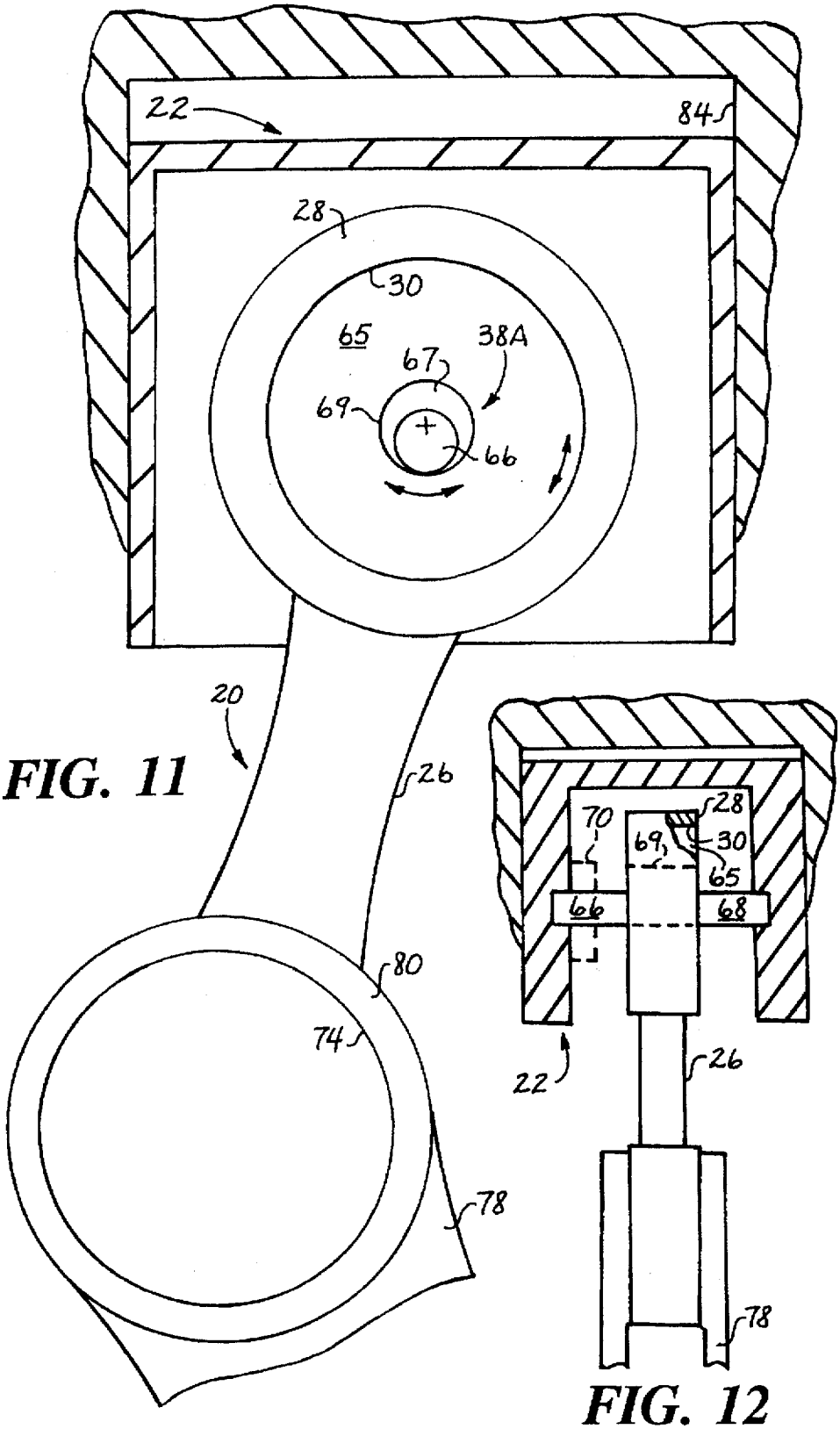
FIG. 11 is a side section view illustrating yet another embodiment of the invention.
FIG. 12 is a side section view further illustrating the piston and connecting rod apparatus of FIG. 11.

An alternate embodiment of the invention is illustrated in FIGS. 11 and 12 and is similar to the apparatus of FIGS. 1 to 3 in that it includes a connecting rod 26 with an upper end 28 and a lower end 80 with crank sleeve 74 sized to rotatably receive an orbiting portion of the crank 78. Upper end 28 defines a cylindrical sleeve 30 which rotatably receives a disk 65. The disk 65 defines a wrist pin bore 69 having a centerline which is collinear with the center line of disk 65. Eccentric wrist pin 38A includes collinear cylindrical portions 66 and 68 eccentric to cylindrical portion 67. Bore 69 receives portion 67. A motor, indicated by dashed lines 70 in FIG. 12, is mounted on the inner surface of cylinder 22 and is operatively associated with and turns portion 66 and pin 38A. Cylindrical bore 69 passes entirely through the disk 65. Portions 66 and 68 are pivotally mounted in the piston 22 as shown in FIG. 12.

In operation of the apparatus of FIGS. 11 and 12, when the crankshaft 68 rotates and moves rod 26, piston 22 reciprocates in cylinder 84 in conventional fashion. Motor 70 is activated at any selected point along the path of travel of piston 22. When motor 70 is activated, portion 66 and pin 38A are rotated. When pin 38A is rotated the movement of piston 22 is advanced or retarded to alter the speed at which the piston 22 is normally moved by the crankshaft at a selected point along the piston's path of travel when the crankshaft is turning at a selected RPM.

The embodiments of the invention shown in FIGS. 9 to 12 enable the piston 22 to be retarded or advanced at any point along its path of travel and independently of the position of the rod 26. The embodiments of the invention shown in FIGS. 9 to 12 also permit the effective length of the rod assembly 20 to be varied by differing amounts at any selected point along the path traveled by the crankshaft or along the path traveled by the piston 22. When the apparatus of FIGS. 9 and 10 does not include unit 55A, slot 61 or motor 62, and instead utilizes unit 55 in conjunction with pin 53 and wrist pin 51, then the effective length of the rod assembly 20 in FIG. 9 is, by way of example, adjusted by altering the distance pin 53 and lower end 80. When neck 60 moves in either of the directions indicated by arrows D and displaces pin 53 to rotate disk 58 about wrist pin 51, the distance between pin 53 and end 80 is altered, and, consequently, the effective length of assembly 20 is altered. Altering the effective length alters the amount by which the speed of travel of piston 22 is advanced or retarded with respect to the speed at which the piston 22 is normally moved by the crankshaft at a selected point along the piston's path of travel when the crankshaft is turning at a selected RPM.

The amount by which the effective length of assembly 20 is altered is controlled by the distance which neck 60 is displaced in one of the directions indicated by arrows D. When the crankshaft and piston are at selected points along their respective paths of travel, say for example when the piston is at TDC, the amount by which the effective length of assembly 20 is altered varies depending on the amount by which neck 20 is displaced. The ability of the invention to vary, at any given point along the path of travel of the crankshaft and piston 22, the amount by which the effective length of assembly 20 is altered is important in the practice of the invention because it enables the amount by which piston 22 is retarded or advanced at a particular point along the path of travel of piston 22 to be varied to compensate for changes in humidity, temperature, and other factors which affect the efficient combustion of fuel.

Figure 13:
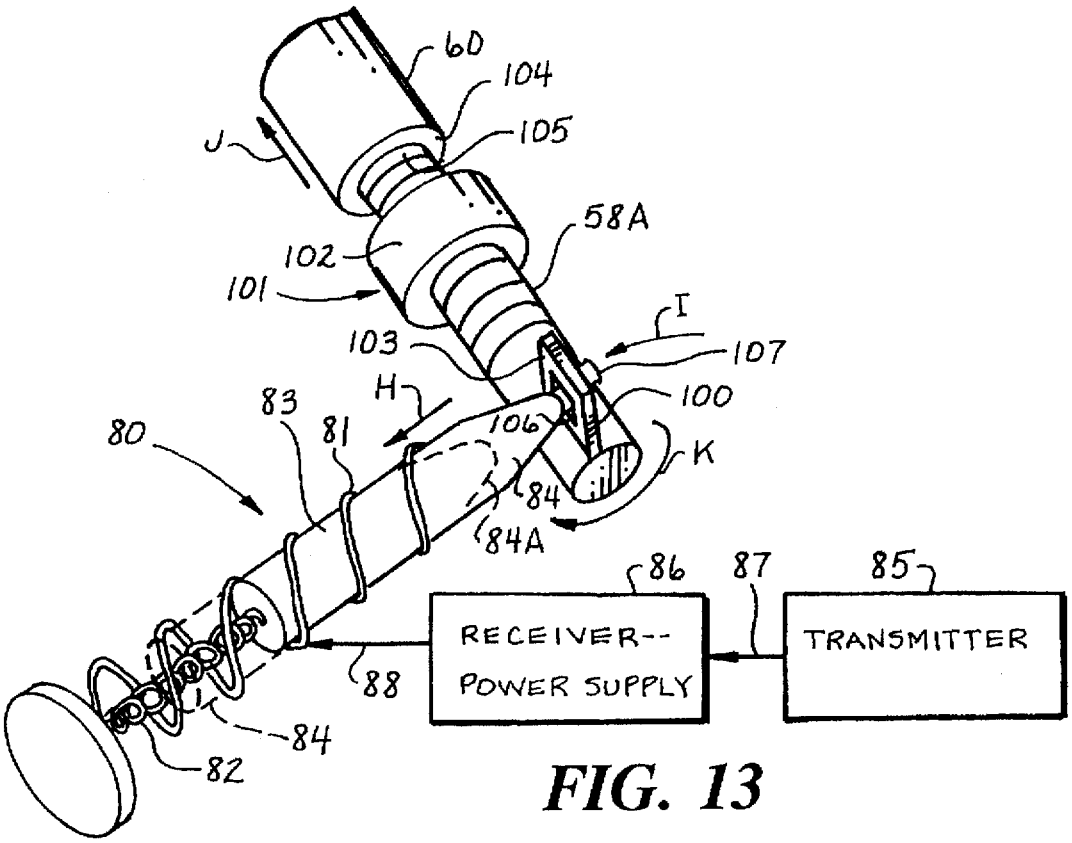
FIG. 13 is a combination schematic—perspective view illustrating a solenoid-transmitter.

FIG. 13 illustrates an optional solenoid apparatus for displacing neck 60 in FIG. 9. The solenoid apparatus includes spring 82, iron armature 83 having conical end 84 pivotally connected to plate or flange 100, solenoid 81, receiver power supply 86, and transmitter 85. Plate 100 is fixedly secured to externally threaded screw 58A which turns through an internally threaded aperture in cylindrical collar 101. End 84 is connected to plate 100 by a bolt 107 which extends through slot 106 formed through plate 100. The outer cylindrical surface 102 of collar 101 is fixedly secured inside cylindrical aperture or recess 56A formed in base 56. End 105 of screw 58A is rotatably connected to end 104 of neck 60 such that end 105 is continuously adjacent and cannot be separated from end 104 and such that screw 58A is free to rotate in the directions indicated by arrow K which neck 60 does not so rotate.

When transmitter 85 activates 87 power supply 86, power supply 86 directs 88 current through solenoid 81 which causes armature 83 and neck 60 to be displaced from the primary position illustrated in FIG. 13 to the position indicated by dashed lines 84A. When end 84 is displaced to the position indicated by dashed lines 84A, end 84 displaces plate 100 and screw 58A in the direction of arrow I. When screw 58A is turned in the direction of arrow I, it moves through sleeve 101 in the direction of arrow J and displaces neck 60 in the direction of arrow J to displace pin 53 away from pin 54. When screw 58A moves in the direction of arrow J, slot 106 slides over bolt 107 in the direction of arrow J. When the transmitter 85 directs receiver 86 to turn off the current through solenoid 81, spring 82 causes armature 83 and neck 60 to return to the primary position shown in FIG. 13, in which case the sequence of events just described is reversed, causing neck 60 to move in a direction opposite that of arrow J and causing conical end 84 and plate 100 to return to the position shown in FIG. 13.

Figure 14:
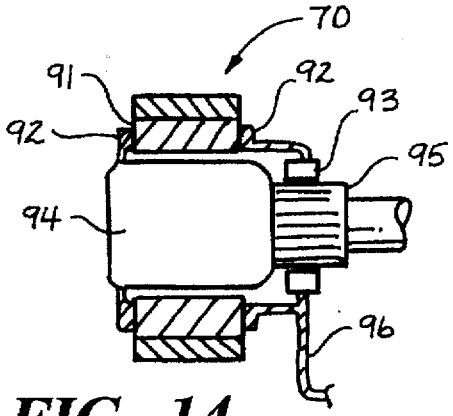
FIG. 14 is a partial section view illustrating a motor.

FIG. 14 illustrates an electric motor use to turn cylindrical portion 66 in FIG. 12. Motor 70 includes field magnet 91, field coils 92, brush 93, armature 94, commutator 95, and lines 96 delivering DC power. When motor 70 is generating a torque on portion 66, the power of motor 70 need not be excessive.

Figure 15:
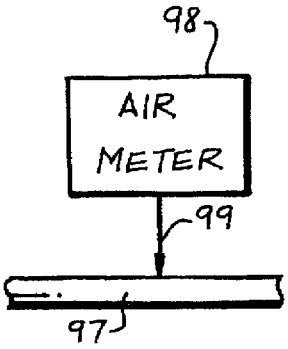
FIG. 15 is a combination schematic—perspective view illustrating a fuel compensator used to control and adjust the fuel-air ratio.

The fuel compensator in FIG. 15 controls and adjusts the fuel-air ratio and includes an air meter 98 which controls the amount of air, and oxygen, intermixed 99 with fuel passing through a fuel line 97. The air meter includes a receiver. In operation, when transmitter 85 activates the solenoid 81 to displace pin 53, the transmitter 85 can also simultaneously activate and control air meter 98 to alter the fuel-air ratio. If desired transmitter 85 can activate air meter 98 before or after transmitter activates solenoid 81. Similarly, transmitter 85 can, instead of activating an air meter 98, activate and control a pump which controls the flow rate of fuel into the engine or carburetor. Transmitter 85 can be mounted in or be in or be at a location separate from piston 22.

Figure 28:
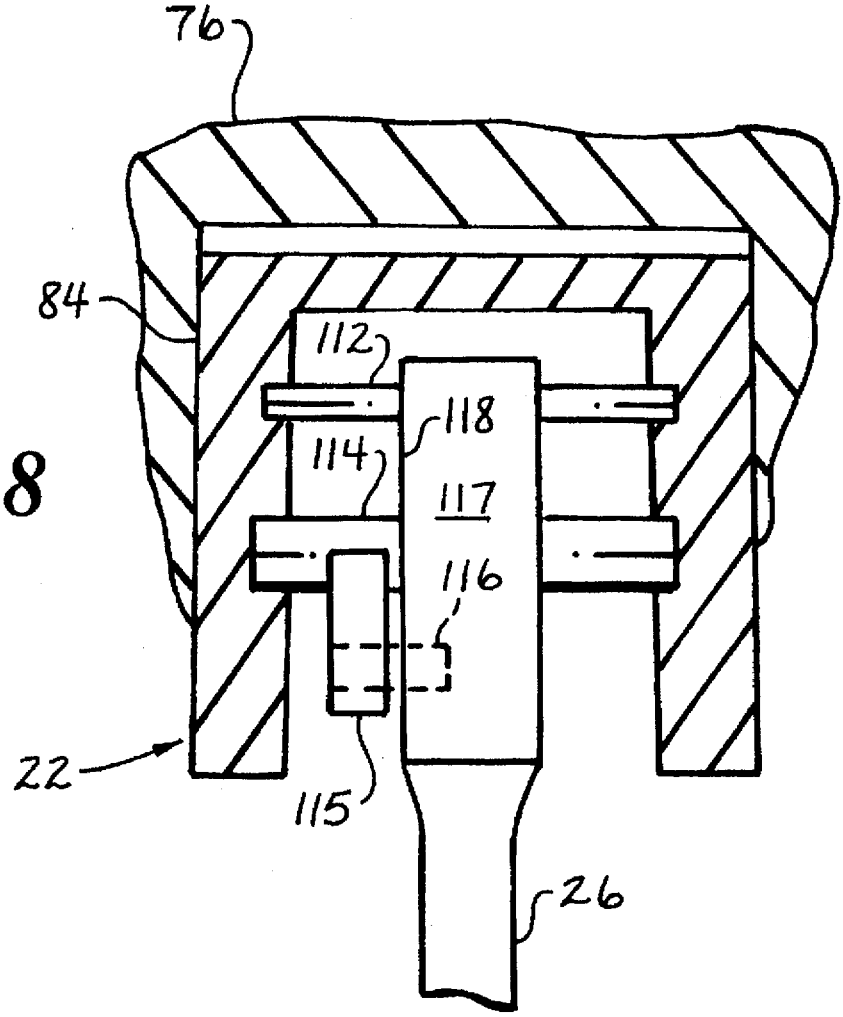
FIG. 28 is a side section view illustrating how the upper ends of the connecting rod assemblies of FIGS. 16 to 25 are positioned inside and connected to a piston.

FIGS. 16 to 20 illustrate a connecting rod assembly 20 which interconnects a piston 22 (not shown in FIGS. 16 to 20; see FIG. 28) and a crank shaft assembly 178. The connecting rod assembly 20 includes a connecting rod 26 having an upper end assembly 110 formed in accordance with yet another embodiment of the invention. The assembly 110 includes U-shaped slot 111 and arcuate slot 113 formed through upper end 117. Pawl 115 is secured to the face 118 of end 117 by pin 116 fixedly secured to end 117 (See FIG. 28). Pawl 115 can freely pivot about pin 116. Pin 114 continuously seats in and/or contacts at least a portion of the arcuate groove 119 in pawl 115. Pins 112 and 114 are fixedly secured to the inner walls of a hollow piston 22 in the manner illustrated in FIG. 28.

Figure 16:
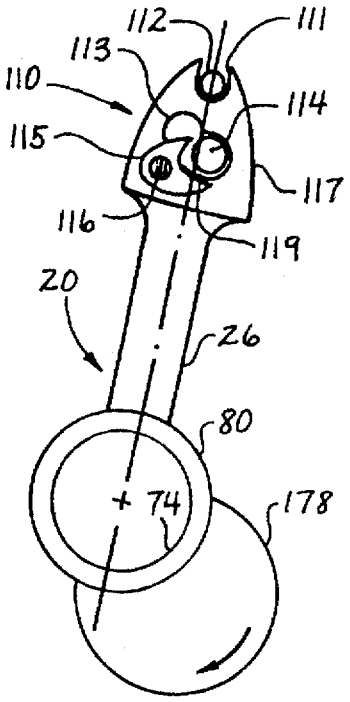
FIG. 16 is a side elevation view illustrating a piston connecting rod assembly constructed in accordance with another embodiment of the invention and moving upwardly toward TDC (top dead center)
Figure 17:
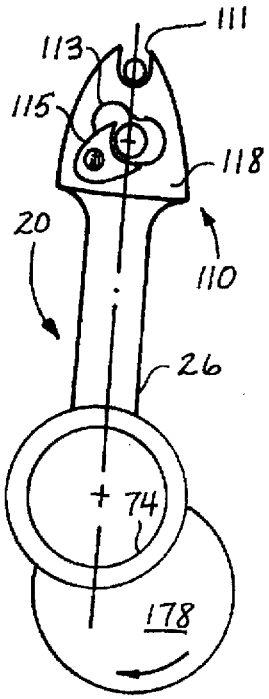
FIG. 17 is a side elevation view illustrating the piston connecting rod assembly of FIG. 16 after the rod assembly has been displaced by the crankshaft further toward TDC.

In operation, in FIG. 16 the connecting rod assembly 20 is moving upwardly and is displacing the piston 22 (not shown in FIG. 16) upwardly toward TDC. In FIG. 17, the upward movement of the rod assembly 20 and piston has continued. When the assembly 20 moves from the position shown in FIG. 16 to the position shown in FIG. 17, slot 113 slides over pin 114 such that pin 114 contacts groove 119 in pawl 115.

Figure 18:
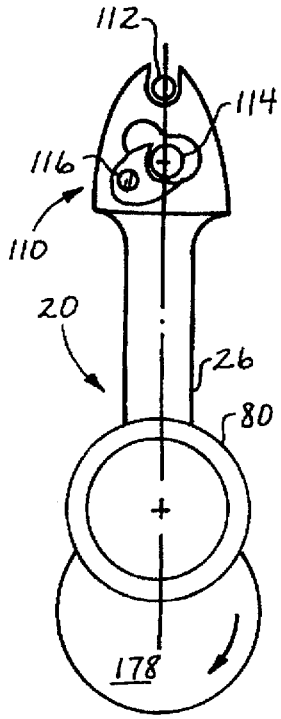
FIG. 18 is a side elevation view illustrating the piston connecting rod assembly of FIGS. 16 and 17 once the piston has reached TDC.

In FIG. 18, the crankshaft assembly 178 has moved the rod assembly 20 and piston 22 (not shown in FIG. 18) to TDC.

In the embodiment of the invention illustrated in FIGS. 16 to 20, pins 112, 114 always move simultaneously with piston 22. In an alternate embodiment of the invention, however, (a) pins 111 and 114 are each fixedly secured in and extend outwardly from upper end 117; (b) a first pair of opposing, spaced apart grooves shaped and dimensioned like groove 111 (or 111A, etc.) are formed on the inner cylindrical wall of piston 22; (c) each groove slidably receives an end of pin 112; (d) a second pair of opposing, spaced apart grooves shaped and dimensioned like groove 113 are formed on the inner cylindrical wall of piston 22; (e) each of the second pair of grooves receive one end of pin 114; (f) a pair of opposed spaced apart pawls 115 are pivotally mounted on the inner wall of piston 22; and, (g) each pawl is adjacent one of the second pair of grooves and pivotally receives and carries one of the ends of pin 114 in the same manner that pawl 115 receives and carries pin 114 in FIGS. 16 to 20.

Figure 19:
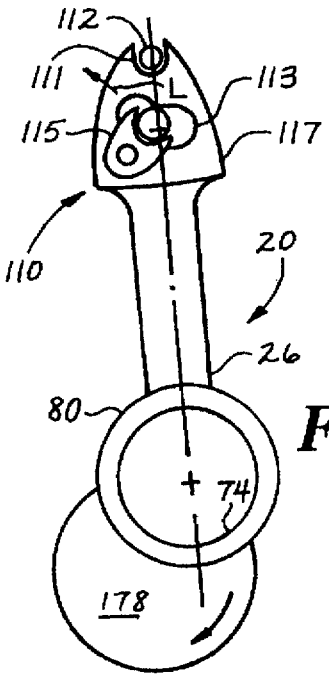
FIG. 19 is a side elevation view illustrating the piston connecting rod assembly of FIG. 16 after the rod assembly has been displaced by the crankshaft past TDC.

Returning to the embodiment of the invention illustrated in FIGS. 16 to 20, in FIG. 19, the crankshaft assembly 178 has moved the rod assembly 20 downwardly away from TDC toward BDC. When, however, the rod assembly 20 moves from the position shown in FIG. 18 to the position shown in FIG. 19, slot 113 slides over pin 114 such that pin 114 seats on groove 119 and rotates pawl 115 about pin 116 in the direction of arrow L. When pin 114 seats in groove 119 and pawl 115 pivots about pin 116 in the direction of arrow L, pawl 115 lifts pin 114 and, consequently, piston 22 so that (1) the movement of piston 22 downwardly toward BDC is retarded and piston 22 does not move toward BDC at the same speed as connecting rod 26 (depending on the shape and dimension of slot 113, the displacement of piston 22 toward BDC can be completely halted and, further, piston 22 may even be displaced away from BDC during the rotation of the crankshaft through a short arc) when assembly 20 moves downwardly from the position shown in FIG. 18 to the position shown in FIG. 19, and (2) slots 111 and 113 slide over pins 112 and 114 respectively.

Figure 20:
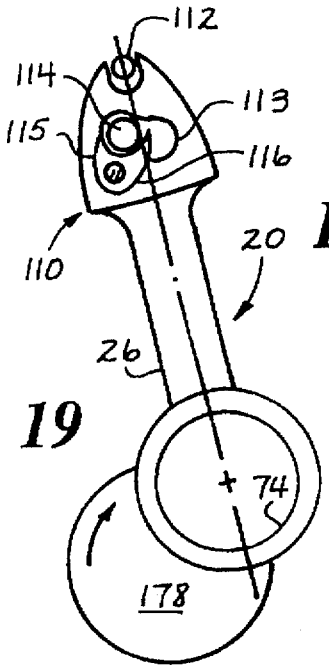
FIG. 20 is a side elevation view illustrating of piston connecting rod assembly of FIG. 18 after the rod assembly has been further downwardly displaced by the crankshaft toward BDC (bottom dead center)

In FIG. 20, the crankshaft assembly 178 has continued to move the rod assembly downwardly away from TDC toward BBC. When the rod assembly 20 moves from the position shown in FIG. 19 to the position shown in FIG. 20, slot 113 continues to slide over pin 114 and pawl 115 further rotates about pin 116 in the direction of arrow L. Pawl 115 continues to support pin 114 and piston 22 when the rod assembly 20 moves from the position shown in FIG. 19 to the position shown in FIG. 20.

When assembly 20 moves from the position shown in FIG. 18 to the position shown in FIG. 20, crankshaft assembly 178 presently typically has rotated through about forty degrees of a complete three-hundred and sixty degree rotational cycle (from BDC to TDC and back to BDC). As would be appreciated by those of skill in the art, slots 112 and 113 can be shaped, contoured and dimensioned and positioned with respect to one another in any desired manner so that, by way of example and not limitation, the lifting of piston 22 can be achieved during rotation of the crankshaft assembly from 190 degrees to 210 degrees instead of during the 180 degrees to 220 degrees rotation period illustrated in FIGS. 18 to 20.

Assembly 20 of FIGS. 16 to 20 continues its rotation from the position shown in FIG. 20 until assembly 20 reaches BDC. By the time assembly 20 reaches BDC, slots 111 and 113 have slid over pins 112 and 114 and pawl 115 has rotated such that pins 112, 114 and pawl 115 have returned to about the position shown in FIG. 16, i.e., pin 112 is seated in the bottom of slot 111 and pin 114 is in the right hand portion of slot 113 as illustrated in FIG. 16. At BDC, rod 26 is vertically oriented in the same manner that rod 26 is vertically oriented in FIG. 18.

FIGS. 21 to 25 illustrate a connecting rod 5 assembly 20 which is identical to the connecting rod assembly in FIGS. 16 to 20 except that slot 111 is replaced with a slot 111A which is canted with respect to the original slot 111. The original slot 111 permits sliding movement of the slot 111 over pin 112 in a direction parallel to the longitudinal axis P of connecting rod 26, i.e., permits sliding movement of slot 111 in a direction parallel to the X axis 126 FIG. 23. In contrast, new slot 111A permits sliding movement of slot 111A over pin 112 in directions of travel which are canted with respect to axis P and in directions of travel which have x-axis 126 and y-axis 127 components. Utilizing a slot 111A which permits sliding movement of the slot in a direction of travel at an angle to axis P facilitates the constant maintenance of a piston 22 in a fixed position while crankshaft assembly 178 continues to rotate through a selected arc.

Figures 21, 22, 23:
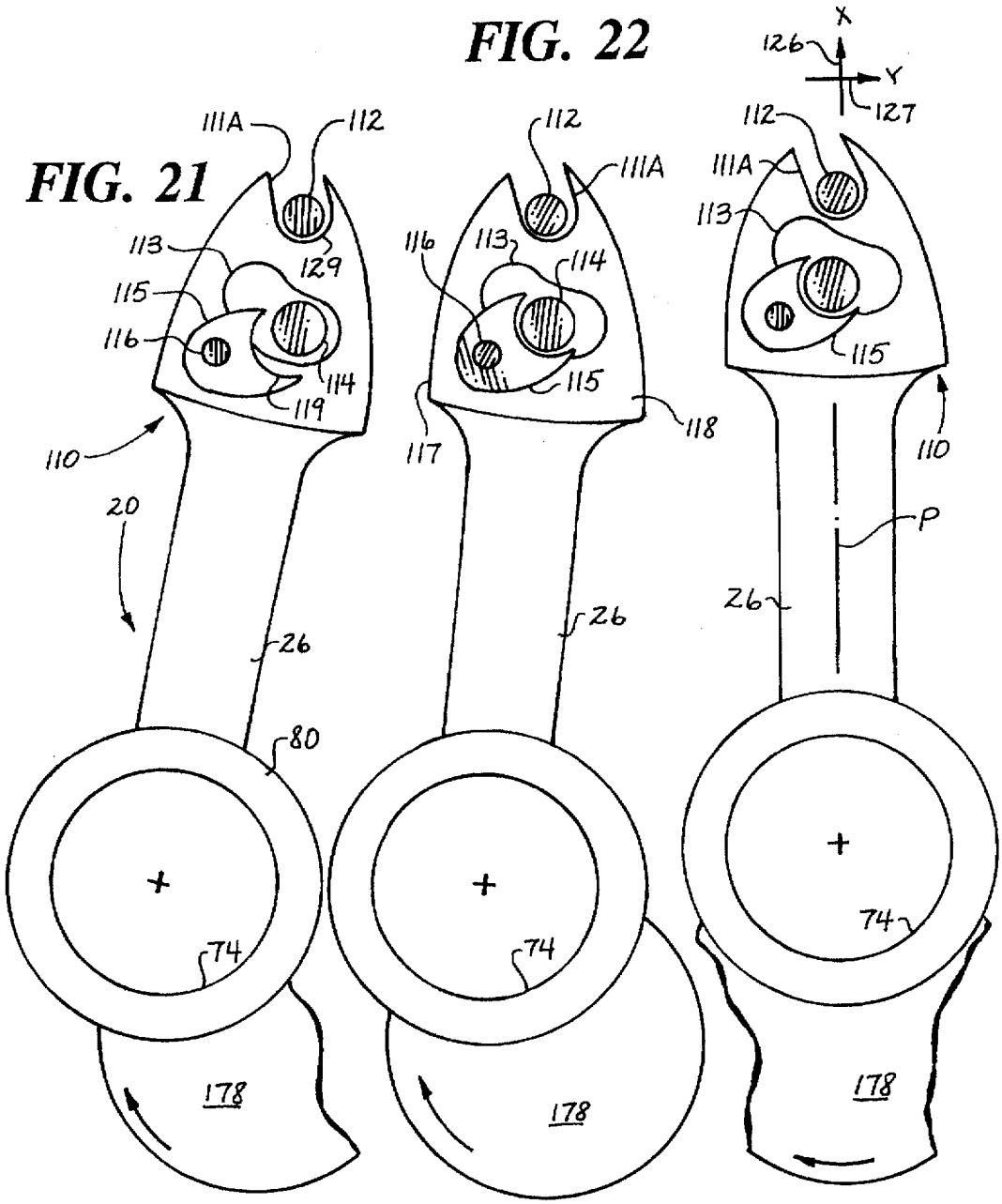
FIG. 21 is a side elevation view illustrating a piston connecting rod assembly constructed in accordance with still another embodiment of the invention and moving upwardly toward TDC (top dead center)
FIG. 22 is a side elevation view illustrating the piston connecting rod assembly of FIG. 21 after the rod assembly has been displaced by the crankshaft further toward TDC.
FIG. 23 is a side elevation view illustrating the piston connecting rod assembly of FIGS. 21 and 22 once the piston has reached TDC.
Figure 24:
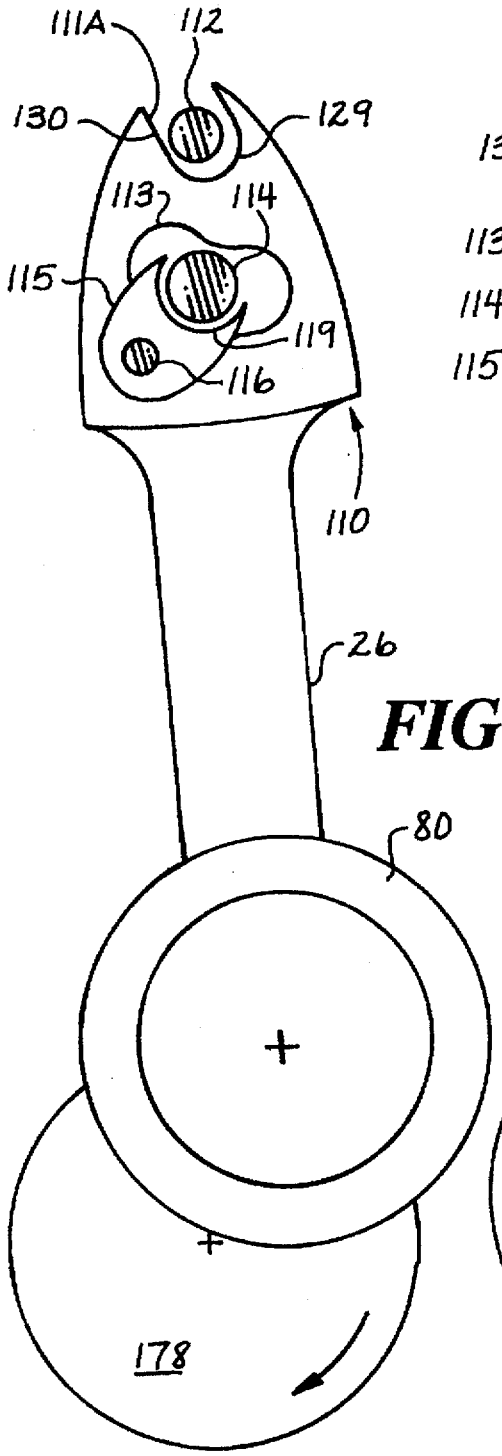
FIG. 24 is a side elevation view illustrating the piston connecting rod assembly of FIG. 21 after the rod assembly has been displaced by the crankshaft past TDC.
Figure 25:
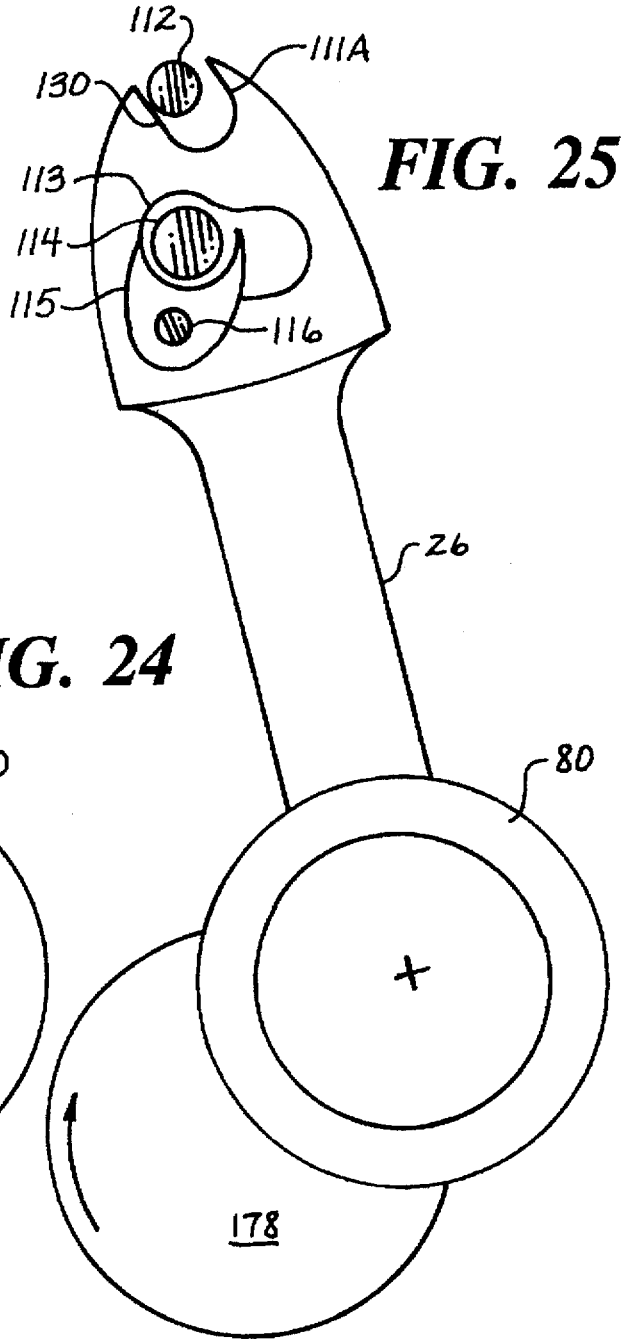
FIG. 25 is a side elevation view illustrating of piston connecting rod assembly of FIG. 24 after the rod assembly has been further downwardly displaced by the crankshaft toward BDC (bottom dead center)

In operation, in FIG. 21 the connecting rod assembly 20 is moving upwardly and is displacing the piston 22 (not shown in FIG. 21) upwardly toward TDC. In FIG. 22, the upward movement of the rod assembly 20 and piston has continued. When the assembly 20 moves from the position shown in FIG. 21 to the position shown in FIG. 22, slot 113 slides over pin 114 such that pin 114 contacts groove 119 in pawl 115. In FIGS. 23 to 25, pin 114 is illustrated spaced apart from groove 119 for the sake of clarity. However, in actual operation, pin 114 is seated in and contacts groove 119 in FIGS. 24 to 25. Similarly, in FIGS. 21 to 23, during operation of the assembly 20, pin 112 actually contacts and is seated in the bottom 129 of slot 111A, even though the drawings illustrate a space between pin 112 and the bottom 129 of slot 111A. In FIGS. 21 to 23 the bottom 129 of slot 111A is supporting and upwardly pushing pin 112.

In FIG. 23, the crankshaft assembly 178 has moved the rod assembly 20 and piston 22 (not shown in FIG. 23) to TDC. In the embodiment of the invention illustrated in FIGS. 21 to 25, pins 112, 114 always move simultaneously with piston 22.

In FIG. 24, the crankshaft assembly 178 has moved the rod assembly 20 downwardly away from TDC toward BDC. When, however, the rod assembly 20 moves from the position shown in FIG. 23 to the position shown in FIG. 24, slot 113 slides over pin 114 such that pin 114 seats on groove 119 and rotates pawl 115 about pin 116 in the direction of arrow L. When pin 114 seats in groove 119 and pawl 115 pivots about pin 116 in the direction of arrow L, pawl 115 lifts pin 114 and, consequently, piston 22 so that (1) the movement of piston 22 downwardly toward BDC is retarded and piston 22 does not move toward BDC at the same speed as connecting rod 26 (depending on the shape and dimension of slot 113, the displacement of piston 22 toward BDC can be completely halted and piston 22 may even be displaced away from BDC) when assembly 20 moves downwardly from the position shown in FIG. 18 to the position shown in FIG. 19, and (2) slots 111A and 113 slide over pins 112 and 114 respectively.

In FIG. 25, the crankshaft assembly 178 has continued to move the rod assembly downwardly away from TDC toward BBC. When the rod assembly 20 moves from the position shown in FIG. 24 to the position shown in FIG. 25, slot 113 continues to slide over pin 114 and pawl 115 further rotates about pin 116 in the direction of arrow L. Pawl 115 continues to support pin 114 and piston 22 when the rod assembly 20 moves from the position shown in FIG. 24 to the position shown in FIG. 25.

When assembly 20 moves from the position shown in FIG. 23 to the position shown in FIG. 25, crankshaft assembly presently typically has rotated through about forty degrees of a complete three-hundred and sixty degree rotational cycle (from BDC to TDC and back to BDC). Slots 111A and 113 are presently preferably shaped and dimensioned such that while assembly 20 moves from the position shown in FIG. 23 to the position shown in FIG. 25, the lift generated by pawl 115 is such that piston 22 is maintained motionless while assembly 20 moves from the position shown in FIG. 23 to the position shown in FIG. 25. As earlier noted, however, when the displacement of piston 22 is altered with respect to the displacement of end 117, piston 22 need not remain motionless.

Assembly 20 of FIGS. 21 to 25 continues its rotation from the position shown in FIG. 25 until assembly 20 reaches BDC. By the time assembly 20 reaches BDC, slots 111A and 113 have slid over pins 112 and 114 and pawl 115 has rotated such that pins 112, 114 and pawl 115 have returned to about the position shown in FIG. 21, i.e., pin 112 is seated in the bottom of slot 111A and pin 114 is in the right hand portion of slot 113 as illustrated in FIG. 21. At BDC, rod 26 is vertically oriented in the same manner that rod 26 is vertically oriented in FIG. 23.

Figure 26:
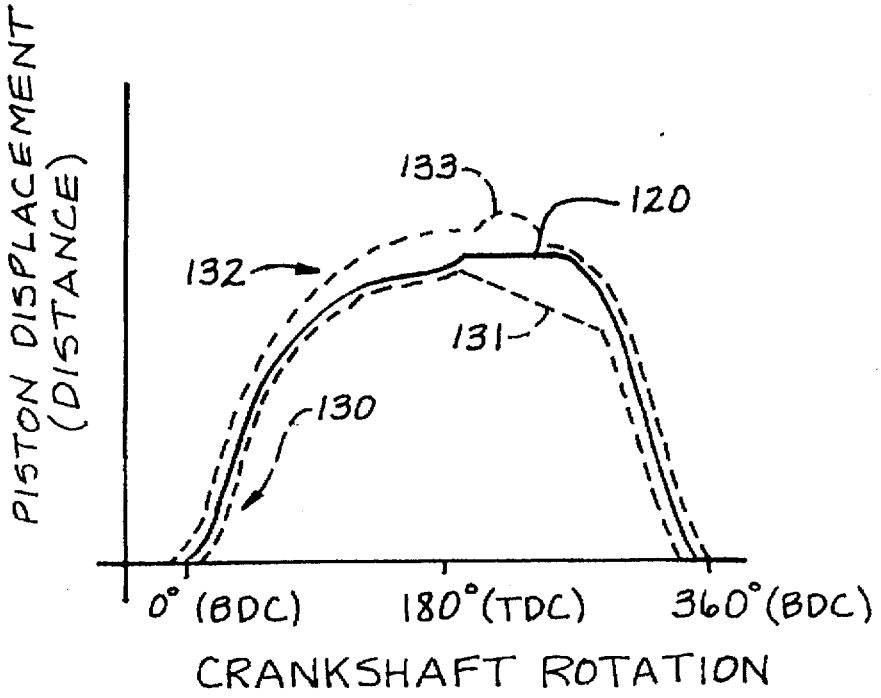
FIG. 26 is a graph illustrating how apparatus constructed in accordance with the invention momentarily halts the displacement of the piston to produce a constant volume combustion area intermediate the top of the piston and top of the piston chamber.

The displacement of piston 22 during operation of the apparatus illustrated in FIGS. 21 to 25 is illustrated by the graph of FIG. 26. As noted by the straight horizontal line 120 in the graph of FIG. 26, the displacement of the piston is temporarily halted after TDC and the piston does not move until after the crankshaft has rotated through an arc of about forty degrees after passing TDC. Horizontal line 120 represents the relationship between the displacement of the pistn (i.e.,the vertical axis styled "PISTON DISPLACEMENT (DISTANCE)") and the rotational position of the crankshaft (i.e., the horizontal axis styled "CRANKSHAFT ROTATION"). Dashed lines 130 and 132 represent optional relationships which can be produced between piston displacement and the rotational position of the crankshaft by altering the shape and dimension of slot 111 (or, by way of further example, by altering the shape and dimension of the U-shaped slot housing pin 12 in FIG. 1 or by altering the rate at which neck 60 is displaced in the direction of arrows D in FIG. 9). The graph indicated by dashed line 130 and the straight linear component 131 thereof and the graph indicated by dashed line 132 and the curved linear component or "bubble" 133 thereof are, as would be appreciated by those of skill in the art, produced by appropriately altering the shape and dimension of slot 111 to produce and define different curved and straight linear relationships between the displacement of the piston and the rotational position of the crankshaft. As is well known, when the upper end of the crank rod and the piston move simultaneously at equivalent speeds throughout the rotation of the crankshaft, the relationship between the displacement of the piston and the rotational position of the crankshaft during one complete revolution of the crankshaft from BDC to TDC and back to BDC is normally defined by a bell curve. The apparatus of the invention can be utilized to alter the normal displacement of the piston 22 at any point along this bell curve. Further, it may be advantageous to alter the normal displacement of the piston 22 more than once. For example, slot 111 may be shaped such that, shortly after the piston passes top dead center, the piston 22 is displaced upwardly away from the crankshaft toward the top of the cylinder for a short period of time to increase the compression ratio to facilitate ignition of fuel in the combustion space in the cylinder above the piston, after which the piston is displaced away from the top of the cylinder toward the crankshaft to reduce the compression ratio by increasing the volume of the combustion space between the top of the cylinder and the piston to slow combustion of the fuel.

During one complete revolution of the crankshaft, the crankshaft rotates from zero degrees (piston at bottom dead center) through an arc of one hundred and eighty degrees (piston at top dead center after crankshaft rotates through an arc of one hundred and eighty degrees) and then through an arc from one hundred and eighty degrees to three hundred and sixty degrees (piston has returned to bottom dead center after crankshaft rotates through an arc of three hundred and sixty degrees).

As used herein, when piston 22 and rod 26 are at TDC they are in a distal substantially motionless position. When piston 22 and rod 26 are at BDC they are in a proximate substantially motionless position because when piston 22 and rod 26 are at BDC they are closer to the crankshaft than when they are in the distal substantially motionless position at TDC.

Figure 27:
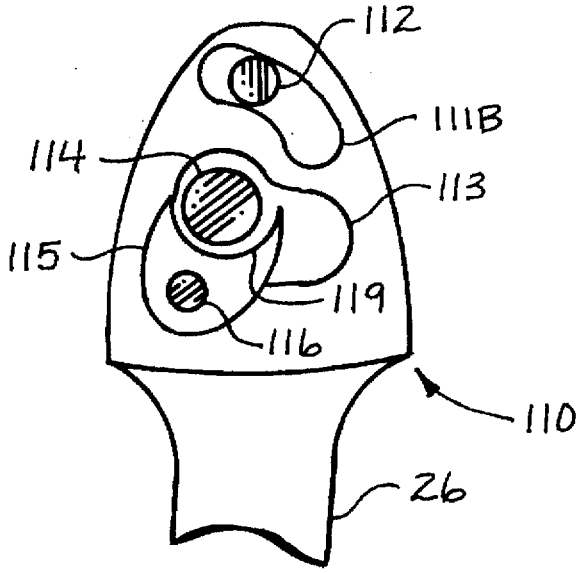
FIG. 27 is a side view illustrating yet another embodiment of the piston connecting rod assembly of the invention.

Still another embodiment of the invention is illustrated in FIG. 27. In FIG. 27, slot 111 has been replaced with enclosed slot 111B. The shape and dimension of slot 113 can also be varied as desired, as can the shape and dimension of slots formed on the inner surfaces of piston 22 to receives the ends of pins 112 and 114 fixedly anchored in end 117.

FIGS. 29 to 32 illustrate a conventional internal combustion engine piston apparatus including a piston 202 which is reciprocated in a cylinder 201 by a connecting rod 203 having a lower end 204 connected to a rotating crankshaft assembly 205.

Figure 29:
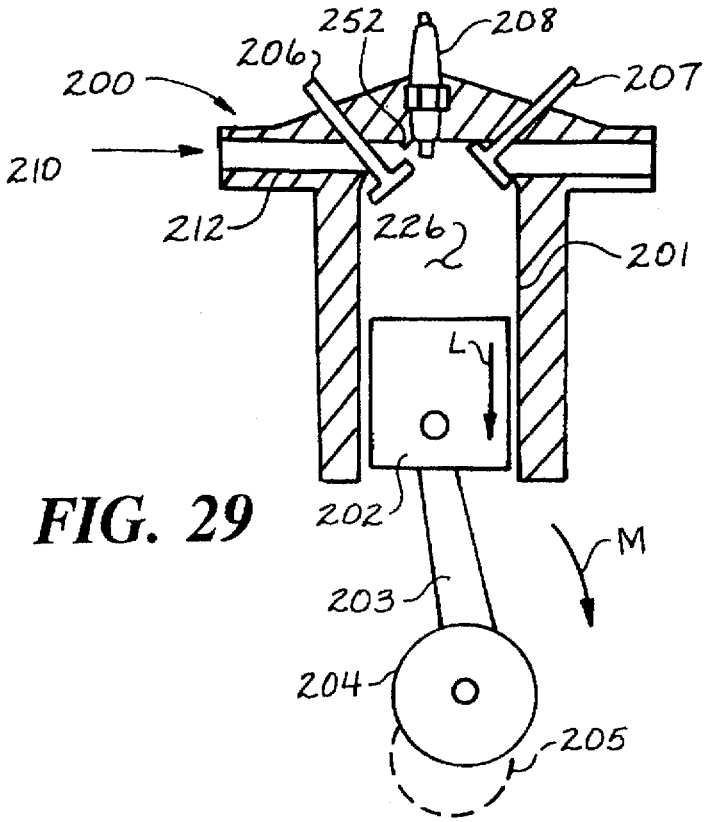
FIG. 29 is a side section view illustrating a conventional piston—cylinder apparatus during the intake stroke.

FIG. 29 illustrates the intake stroke of piston 202 during which piston 202 moves in the direction of arrow L and rod 203 rotates in the direction of arrow M. During the intake stroke, intake valve 206 is open to permit air and fuel to enter the combustion chamber 226 in the direction of arrow 210 through conduit 212. A fuel pump, carburetor, and other well known apparatus can be utilized to inject fuel and air (or other gases or components) into combustion chamber 226. At the end of the intake stroke, valve 206 closes.

Figure 30:
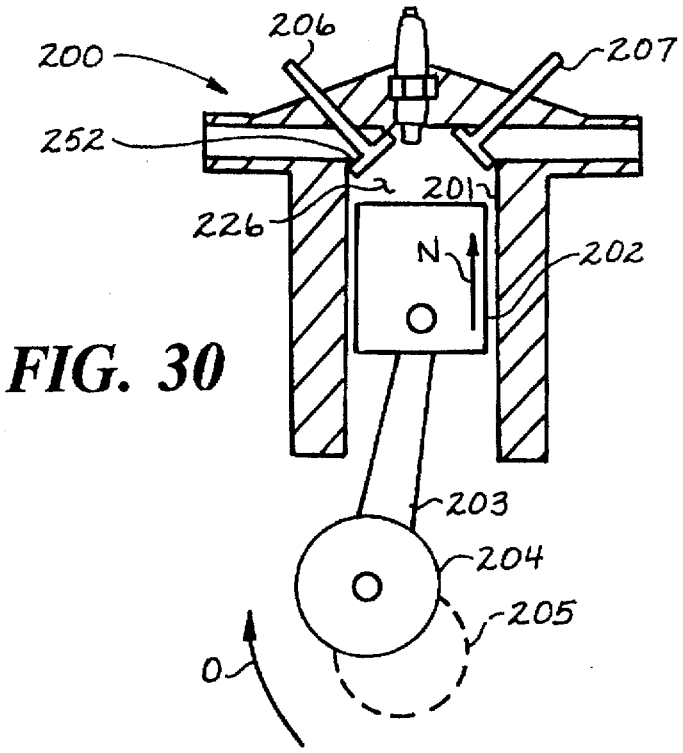
FIG. 30 is a side section view illustrating a conventional piston—cylinder apparatus during the compression stroke.

During the compression stroke shown in FIG. 30, piston 202 travels in the direction of arrow N and the lower end 204 of rod 203 travels in the direction of arrow 0 to reduce the volume of chamber 226 and compress the air—fuel mixture in chamber 226. During the compression stroke, piston 202 moves in the direction of arrow N and lower end 204 is moved by crankshaft 205 in the direction of arrow 0. As would be appreciated by those of skill in the art, for each position of piston 202 in cylinder 201, the combustion chamber has a specific shape, dimension, and volume. Each time piston 202 moves from one position in cylinder 201 to another position, the shape, dimension, and volume of chamber 226 varies. For example, when piston 202 moves from the position shown in FIG. 29 to a position further away from plug 208, the size and volume of chamber 226 increases (even if open valve 206 does not close). When piston 202 moves from the position shown in FIG. 32 to a position closer to plug 208, the size and volume of combustion chamber 226 decreases (assuming valve 207 remains open).

Figure 31:
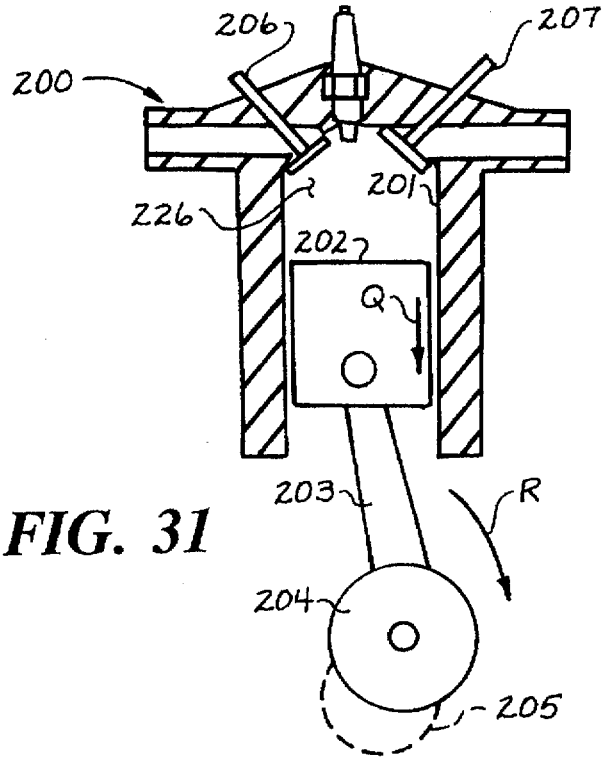
FIG. 31 is a side section view illustrating a conventional piston-cylinder apparatus during the power stroke.

At about the completion of the compression stroke of piston 202, spark plug 208 ignites the fuel-air mixture in chamber 226 to begin the power stroke of piston 202 illustrated in FIG. 31. During the power stroke piston 202 travels in the direction of arrow Q and the lower end 204 of rod 203 is rotated by crankshaft 205 in the direction of arrow R. During the compression stroke and power stroke of piston 202, valves 206 and 207 are closed.

Figure 32:
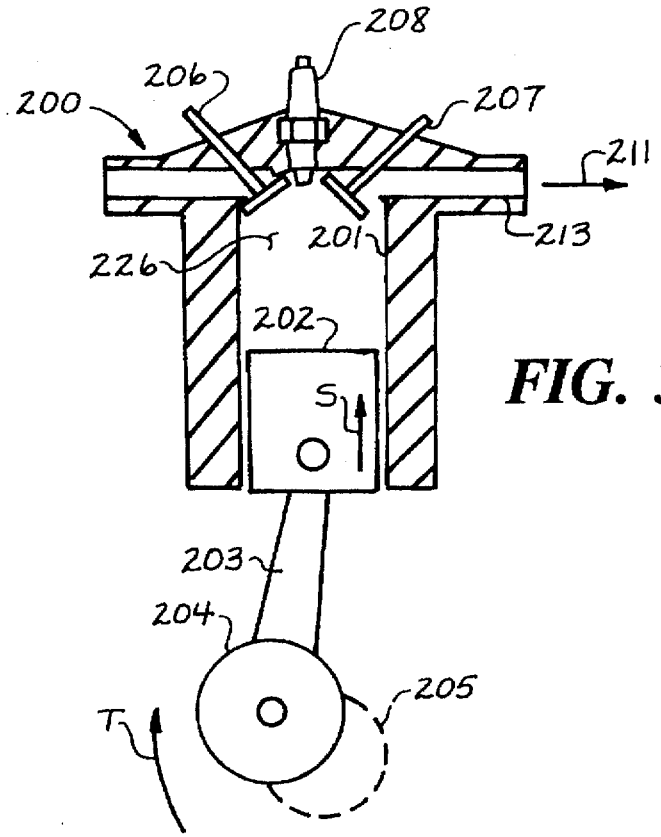
FIG. 32 is a side section view illustrating a conventional piston-cylinder apparatus during the exhaust stroke.

The compression stroke of piston 202 is followed by the exhaust stroke. The exhaust stroke is illustrated in FIG. 32. During the exhaust stroke, outlet valve 207 is opened to permit exhaust gases and material to exit through conduit 213 in the direction of arrow 211.

FIGS. 33 to 35 illustrate an intake valve 206A apparatus which can be utilized in the conventional piston—cylinder internal combustion engine apparatus illustrated in FIGS. 29 to 32. A conventional exhaust valve 207 can, if desired, also be adapted in the manner of intake valve 206A. The external dimensions of valve 206A can (but do not have to) be substantially identical to those of a conventional intake valve so that the valve 206A can be readily installed in an existing engine. Valve 206A differs from a conventional valve 206 in that cylindrical bores 216 and 225A are formed concentric with the longitudinal centerline of the valve to slidably receive cylindrical piston 225 fixedly secured to cylindrical shaft 215 which extends outwardly from the cylindrical body 218 of valve 206A. As shown by FIGS. 33 and 33A, valve 206A also includes circular lip 219 at its lower end and circular lip 217 on the top of the valve.

Shaft 215 can include a finger 228 which is fixedly attached to and extends outwardly away from shaft 15 into a cylindrical opening 227 or another slot formed in body 218. Spring 229 mounted in opening 227 maintains shaft 15 in the normal operative position illustrated in FIG. 34. Shaft 215 and piston 225 are displaced in the direction of arrow W to the position shown in FIG. 35 by rotating shaft 24 in the direction of arrow U to turn cam surface 223 over the end of shaft 215 which contacts surface 223. When piston 225 is in the position shown in FIG. 35, finger 228 is displaced to the position shown in FIG. 35 and compresses spring 229. When shaft 224 is again rotated to turn cam surface 223 to the position shown in FIG. 34, then spring 229 is permitted to expand and return shaft 215 and piston 225 to the position illustrated in FIG. 34. Shaft 224 is fixedly secured to cam 220 and rotates in the direction of arrow U about a fixed axis. Cam 220 is similar to conventional cams used to periodically displace or "open" valves in internal combustion engines, except that an additional cam surface 223 is formed in the central portion of cam 220 to periodically displace shaft 215 and piston 225. The gearing and motive power used to periodically displace intake and outlet valves 206 and 207 in internal combustion engines is well known in the art and will not be discussed herein. Any desired means can be utilized to periodically reciprocate and displace a valve 206, 207 and to reciprocate and displace shaft 215 and piston 225.

In the embodiment of the invention illustrated in FIGS. 33 to 35 it is intended that piston 225 be displaced outwardly into combustion chamber 226 while valve 206A remains closed. Those of skill in the art can, however, appreciate that cam surfaces 221,222 and 223 can be shaped and dimensioned such that piston 225 is displaced outwardly away from bottom 219A at any desired time, i.e., while valve 206A is open, is closed, or is being moved between an open and closed position.

When piston 225 is moved into chamber 226 in the manner illustrated in FIG. 35, piston 225 functions to decrease the volume of the chamber 226. If desired, instead of being displaced outwardly away from bottom 219A into the combustion chamber 226 in the manner shown in FIG. 35, cam 223, the spring loading of shaft 215 and shape of openings 225A and 216 can be configured such that piston 225 is instead displaced away from combustion chamber 226 and is withdrawn into cylindrical opening 225A in a direction of travel opposite that indicated by arrow W. Such a displacement of piston 225 in a direction opposite that of arrow W functions to increase the size of chamber 226. In order to permit such a displacement of piston 225 in a direction opposite that of arrow W, the depth of opening 225A would have to be increased in the manner indicated by dashed line 225B, and, finger 228 would have to be positioned and spring biased in a central portion of opening 227 such that finger 228 could be displaced in opening 227 in a direction away from opening 225A.

Figure 36:
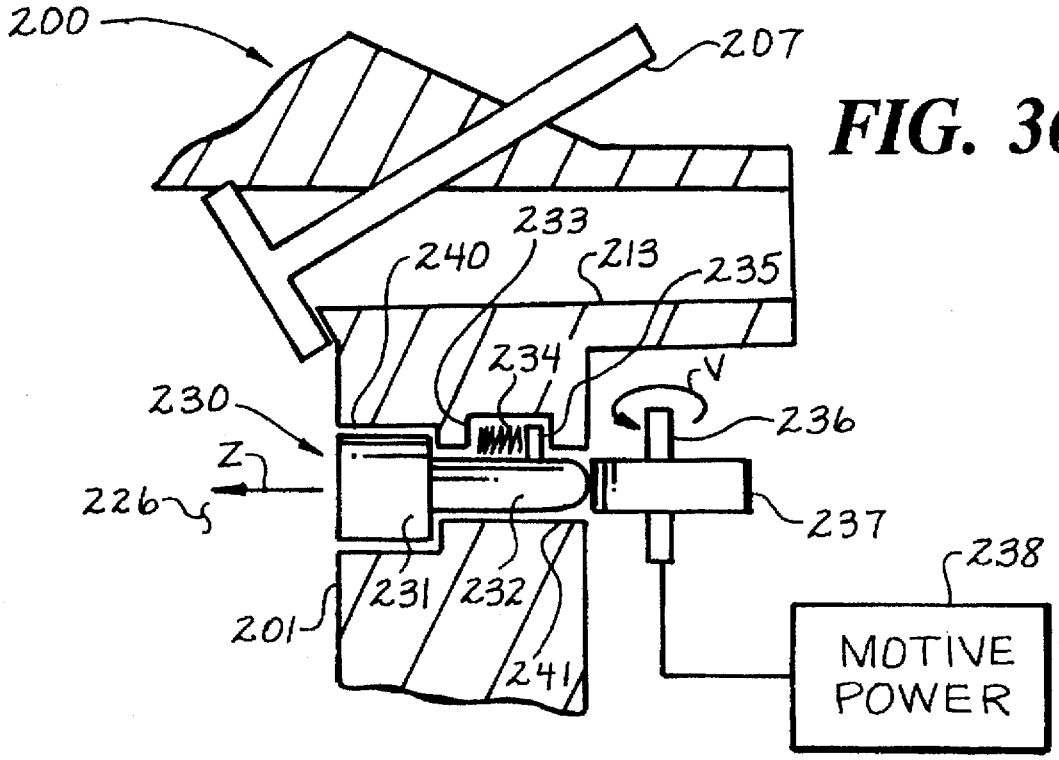
FIG. 36 is a side section view of a plunger apparatus mounted in the wall of the cylinder of an internal combustion engine.
Figure 37:
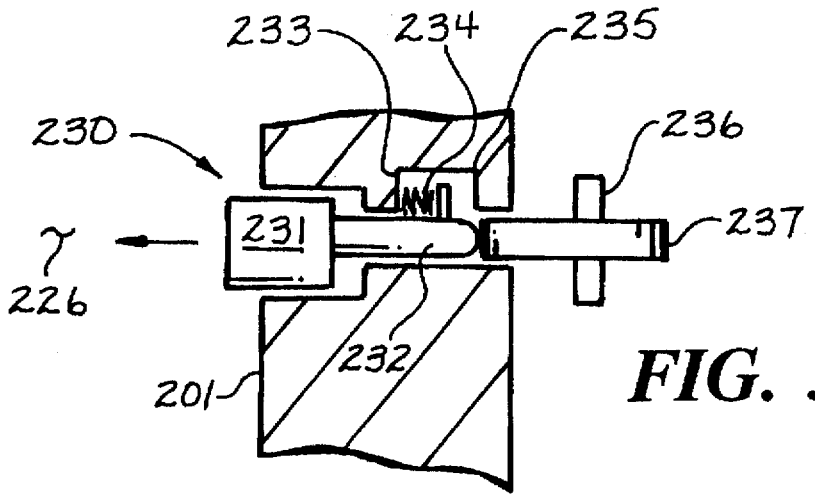
FIG. 37 is a side section view of the plunger of FIG. 37 illustrating the mode of operation thereof.

FIGS. 36 and 37 illustrate another embodiment of the invention in which a piston member 230 is mounted in cylindrical openings 240, 241 formed in the side of cylinder 201. Spring 234 is mounted in slot 233 and normally presses pin 235 against one end of slot 233 in the manner shown in FIG. 36. Pin 235 is fixedly secured to cylindrical shaft 232. Shaft 232 outwardly depends from cylindrical piston or plunger 231. Shaft 236 is fixedly attached to cam 237 such that shaft 236 can be rotated about a fixed axis in the direction indicated by arrow V in FIG. 36. A motor or other motive power means 238 provides motive power to turn shaft 236 to move plunger 231 outwardly from the wall of cylinder 201 in the direction of arrow Z and into chamber 226 to the position shown in FIG. 37 to change the shape and dimension of and decrease the volume of chamber 226. The volume of chamber 226 is decreased because plunger 231 occupies some of the original volume or space in chamber 226.

If desired, the embodiment of the invention illustrated in FIGS. 36 and 37 can be configured to withdraw piston 231 away from chamber 226 and wall 201 (i.e., the length or depth of opening 240 is increased so plunger 231 can be moved in a direction opposite that of arrow Z and away from chamber 226 and cylinder 201) in order to increase the volume of chamber 226. The volume of chamber 226 is increased because when plunger 231 is withdrawn into cylindrical opening 240 away from chamber 226 and from the position shown in FIG. 36, the area of opening 240 immediately adjacent chamber 226 is opened up, which increases the open space and volume comprising chamber 226.

In another embodiment of the invention, slot 233, spring 234, pin 235, cam 237, and shaft 236 are not utilized in the apparatus shown in FIGS. 36 and 37. Instead, shaft 232 is externally threaded and opening 241 is internally threaded so that shaft 232 is turned in opening 241 to move plunger 231 from the position shown in FIG. 36 in the direction of arrow Z and into and out of chamber 226. Any desired motive power means can be utilized to turn threaded shaft 232.

In yet embodiment of the invention, valve 206A is not provided with shaft 215, plunger 225, or openings 225A, 216, 227. Valve 206A is instead solid and the lower end or head of the valve is reshaped to include solid cylindrical valve head portion 250 having circular outer lip 251. Cam 220 need not include or use surface 223, only surfaces 221 and 222 displace valve 206A. When valve 206A includes cylindrical head portion 250, valve 206A is not open to permit fuel and air to enter chamber 226 until valve 206A is displaced far enough into chamber 226 to permit head portion 250 to be moved past circular sealing lip 252 (FIGS. 29, 30) and into chamber 226. Consequently, in the embodiment of the invention which includes head portion 250, an inlet valve 206A can be displaced a distance into chamber 226 without actually opening the valve 206A to permit air and fuel to enter chamber 226. Conversely, an outlet valve 207 similarly configured can be displaced a distance into chamber 226 without actually opening the valve to permit exhaust to leave chamber 226.

As would be appreciated by those of skill in the art, various apparatus can be designed to displace pistons, plungers, or other masses into or out of chamber 226 in order to alter the volume of chamber 226. This is presently preferably carried out while the valves 206, 207 are both closed, although such need not always be the case.

Although chamber 226 is referred to herein as the combustion chamber, it is understood that the use of chamber 226 is not limited to combustion. As shown in FIGS. 29 to 32, combustion chamber 226 is utilized to receive a fuel-air mixture, to compress the mixture, to combust the compressed mixture, and to exhaust the gases and byproducts produced during combustion.

Figure 38:
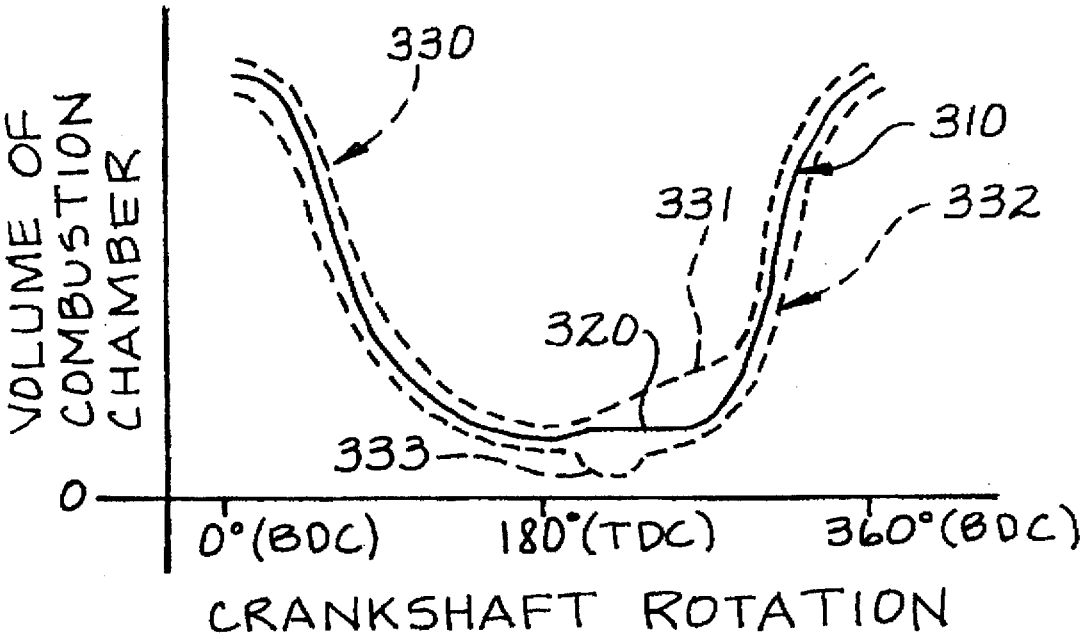
FIG. 38 is a graph illustrating the relation between the combustion volume and position of the crankshaft in the apparatus of the invention.

The alteration of the volume of combustion chamber 226 during operation of the apparatus illustrated in FIGS. 33 to 37 is illustrated by the graph of FIG. 38. As noted by the straight horizontal line 320 of curve 310 in the graph of FIG. 38, the normal increase in volume of chamber 226 after piston 202 moves past TDC can be temporarily offset by withdrawing, in the manner earlier described, piston 225 into valve 206A to decrease the volume of chamber 226. Horizontal line 320 represents the relationship between the volume of chamber 226 (i.e., the vertical axis styled "VOLUME OF COMBUSTION CHAMBER") and the rotational position of the crankshaft (i.e., the horizontal axis styled "CRANKSHAFT ROTATION"). Dashed lines 330 and 332 represent optional relationships which can be produced between the volume of chamber 226 and the rotational position of the crankshaft by controlling the increase or decrease of the volume of chamber 226 with a piston 225, plunger 231, valve head portion 250, etc. The graph indicated by dashed line 330 and the straight linear component 331 thereof and the graph indicated by dashed line 332 and the curved linear component or "bubble" 333 thereof are, as would be appreciated by those of skill in the art, produced by appropriately altering the rate at which piston 225, plunger 231 are displaced into or away from chamber 226 to produce and define different curved and straight linear relationships between the volume of chamber 226 and the rotational position of the crankshaft. As is well known, when the upper end of the crank rod and the piston move simultaneously at equivalent speeds throughout the rotation of the crankshaft, the relationship between the volume of chamber 226 and the rotational position of the crankshaft during one complete revolution of the crankshaft from BDC to TDC and back to BDC is normally defined by a bell curve. The apparatus of the invention can be utilized to alter the normal volume of chamber 226 at any point along this bell curve. Further, it may be advantageous to alter the normal volume of chamber 226 more than once. For example, shortly after the piston passes top dead center during the compression stroke illustrated in FIG. 30, the piston 225 is displaced into the combustion chamber for a short period of time to increase the compression ratio to facilitate ignition of fuel in the combustion space in the cylinder above the piston, after which the piston 225 is drawn back into valve 206A to reduce the compression ratio by increasing the volume of the combustion space between the top of the cylinder and the piston to slow combustion of the fuel.

The apparatus of FIGS. 33 to 37 can, if desired, be utilized in combination with the apparatus of FIGS. 1 to 25, 27 and 28.

Figure 39:
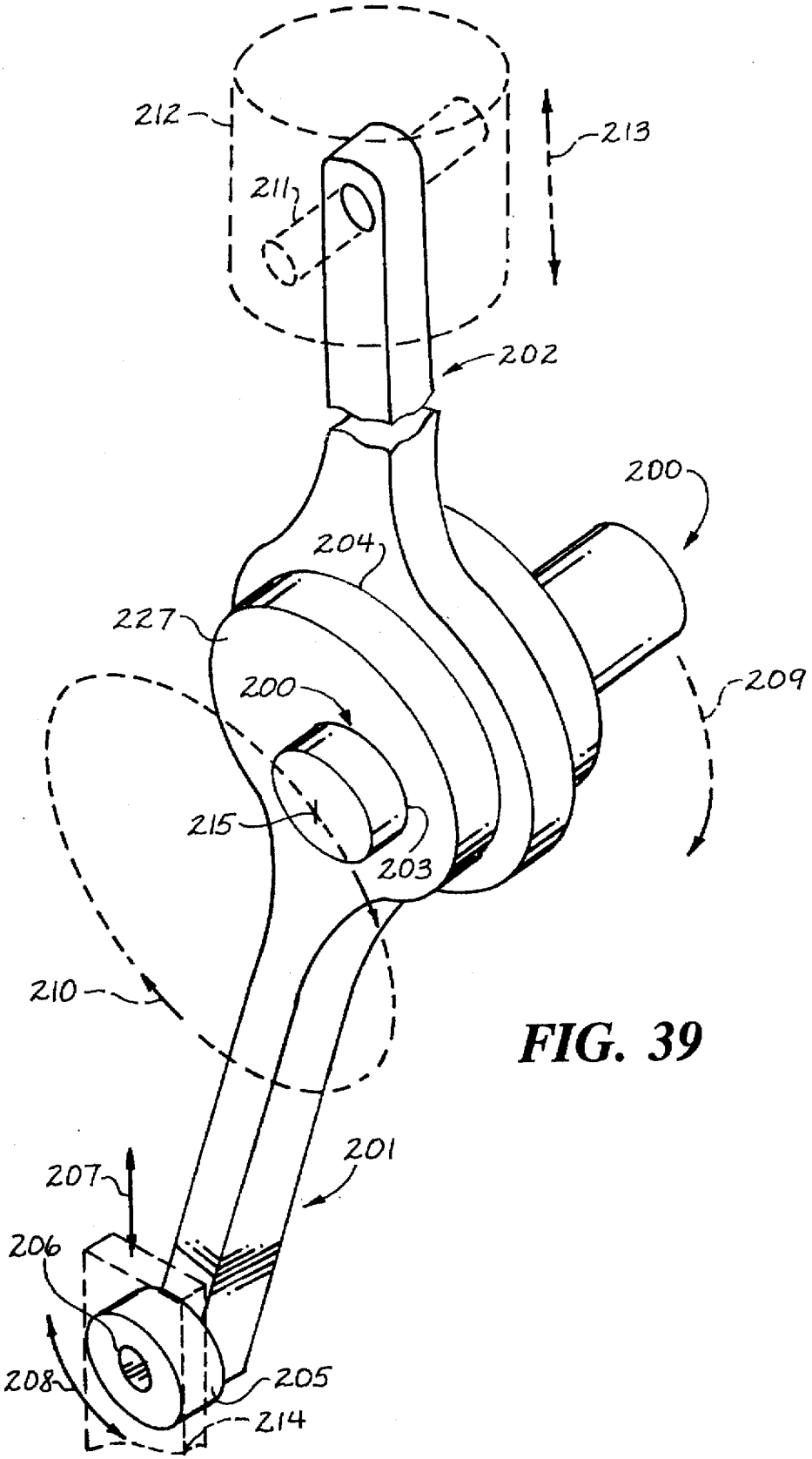
FIG. 39 is a perspective view of another embodiment of the invention.
Figure 40:
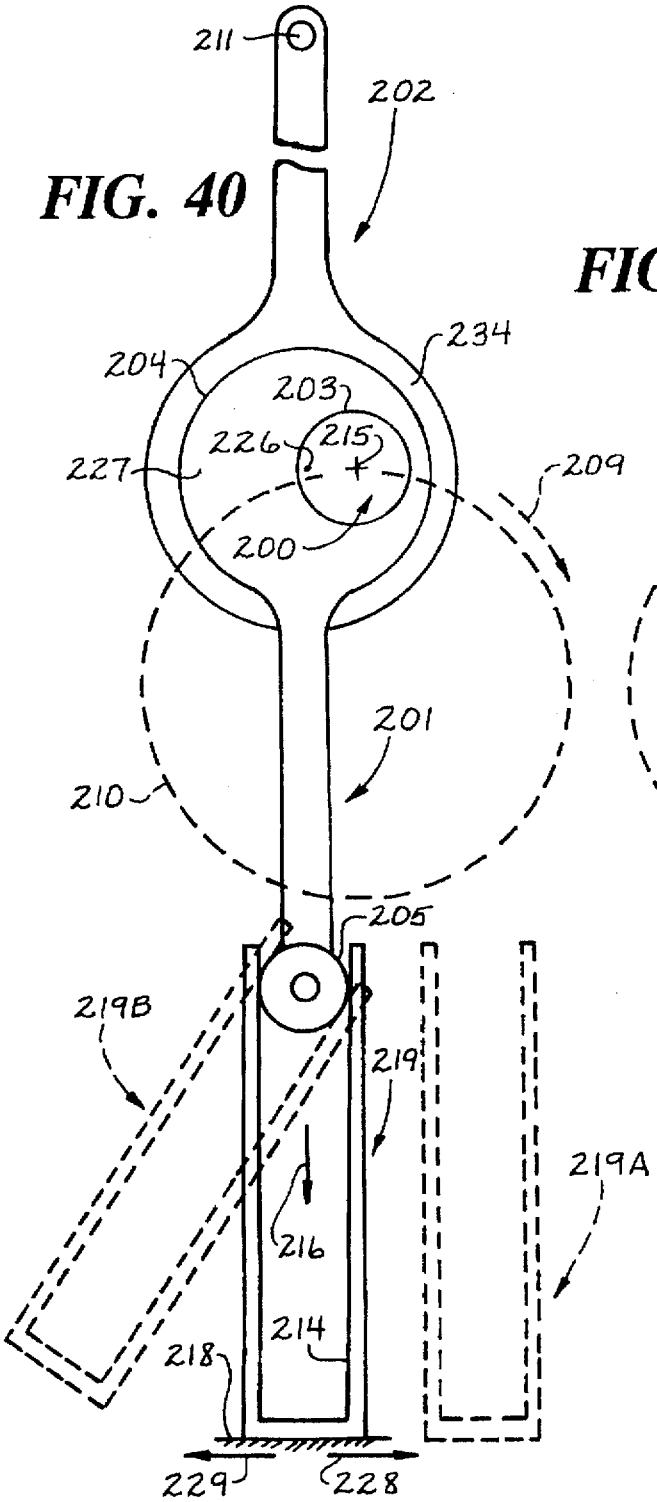
FIGS. 40 and 41 are front views of the apparatus of FIG. 39 illustrating the mode of operation thereof; and, FIG. 42 is a front view of yet another embodiment of the invention.
Figure 41:
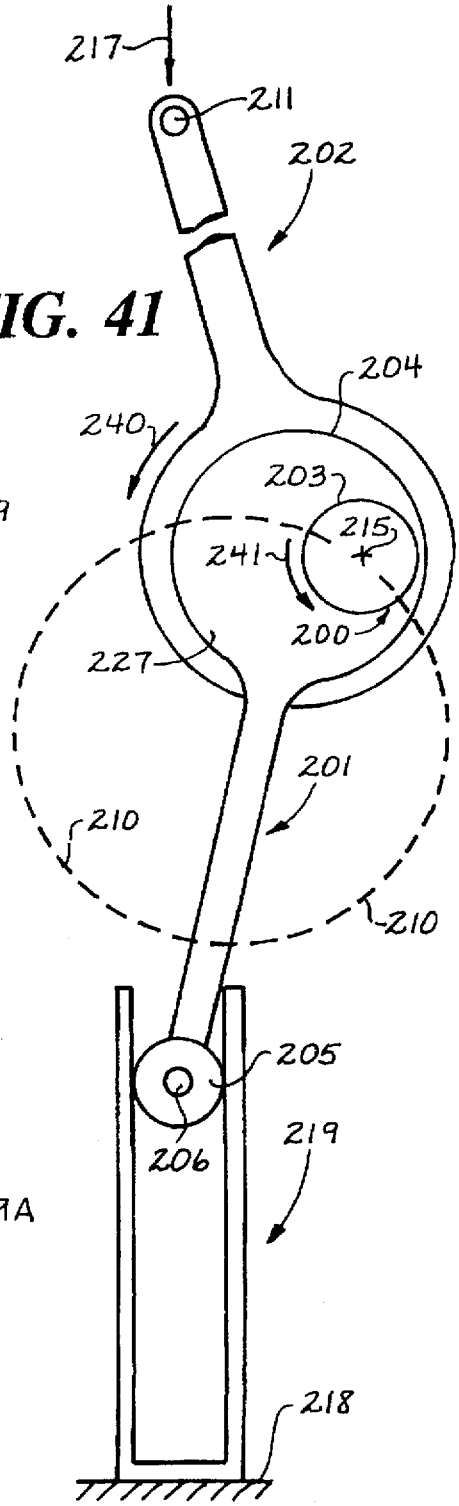

Another embodiment of the invention is illustrated in FIGS. 39 to 41 and includes the crankshaft 200 of a conventional piston—cylinder internal combustion engine of the type commonly found today in most automobiles. During operation of such an internal combustion engine, the longitudinal axis or centerline 215 of crankshaft 200 moves along a circular path of travel indicated in FIGS. 39 to 41 by dashed lines 210.

Arm 201 is mounted on crankshaft 200. Cylindrical aperture 203 formed through the cylindrical proximate end 227 of arm 201 freely slides over and turns about crankshaft 200 while crankshaft 200 moves along path 210. As is readily seen in FIGS. 39 to 41, aperture 203 comprises an eccentric. The centerpoint of cylindrical opening 203 (and of shaft 200 extending through opening 203) is offset from the centerpoint 226 of proximate end 227. Roller 205 is mounted on and freely turns about pin 206 fixedly attached to the distal end of arm 201. Roller 205 rolls up and down along U-shaped slot 214 in the directions indicated by arrows 207 in FIG. 39. Slot 214 is formed in a housing 219.

Figure 42:
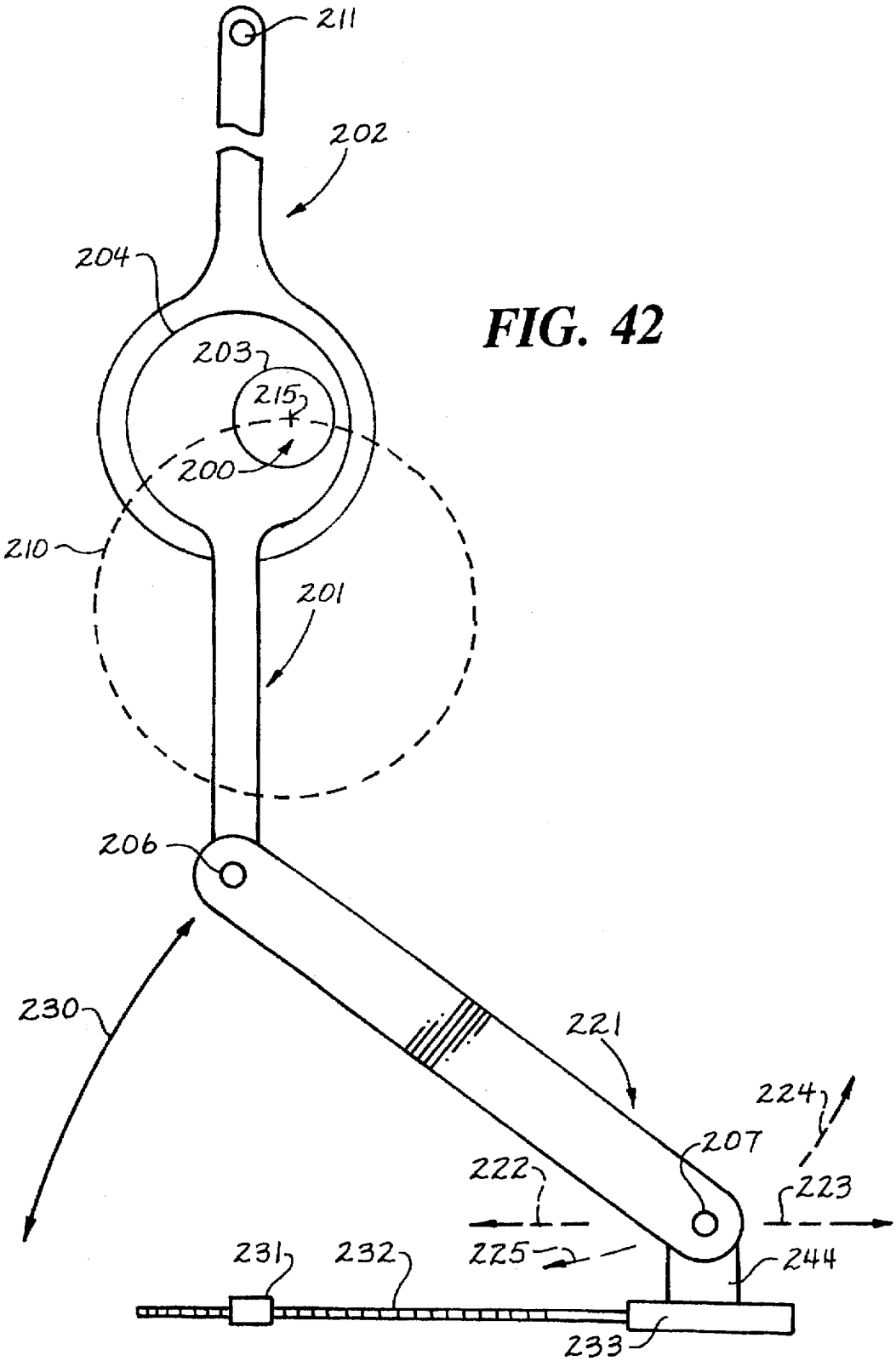

Housing 219 can be secured to a surface 218 in a constant fixed position while the apparatus of FIGS. 39 to 1 operates. Alternatively, means can be provided to alter the position of housing 219 (and slot 214) before or during operation of the apparatus. Means can be provided for displacing housing 219 in the directions indicated by arrows 229, 228 to a new position in which housing 219 is parallel to the original position of housing 219 shown in FIGS. 40 and 41. For example, housing 219 can be mounted on a member 233 (FIG. 42). An externally threaded screw 232 is connected to member 233. Means are provided for turning internally threaded sleeve to displace screw 232 and member 233 in the directions indicated by arrows 222 and 223. Member 233 could, for example, be utilized to displace laterally housing 219 from the position shown in FIG. 40 to the position shown by dashed lines 219A. Laterally displacing housing 219 and slot 214 alters the compression ratio of the engine apparatus of FIGS. 39 to 41.

Similarly, housing 219 and slot 214 can, prior to or during operation of the engine apparatus of FIGS. 39 to 41, be canted from the position shown in FIG. 40. For example, housing 219 can be canted to the position indicated by dashed lines 219B in FIG. 40. Canting housing 219 alters the length of the period of time during which constant volume occurs during each revolution of crankshaft 200 at a selected speed. Crankshaft 200 completes one revolution each time it moves a distance equal to the length of path 210.

Arm 202 is mounted on the cylindrical proximate end 227 of arm 201. Cylindrical aperture 204 formed through the cylindrical proximate end 234 of arm 202 freely slides over and turns about end 227 while crankshaft 200 moves along path 210. The centerpoint of cylindrical opening 204 coincides with the centerpoint 226 of the proximate end 227 of arm 210. The centerpoint of opening 204 is offset from the centerpoint 226 of opening 203. The distal end of arm 202 is pivotally mounted on pin 211. Pin 211 is inside and fixedly secured to a hollow piston 212. During operation of the engine apparatus of FIGS. 39 to 42, piston 212 moves up and down in a cylinder (not shown) in conventional fashion in the directions indicated by arrows 213. Fuel is combusted in the cylinder to displace piston 212 in the directions indicated by arrows 213 to turn crankshaft 200.

In FIG. 41, crankshaft 200 has moved along path 210 in the direction of arrow 209 away from the position of crankshaft 200 in FIG. 40. When crankshaft 200 moves from the position shown in FIG. 40 to the position shown in FIG. 41, pin 211 and piston 212 is displaced downwardly in the direction of arrow 217; cylindrical aperture 204 turns and slides over the outer cylindrical surface of proximate end 227 in the direction of arrow 240; cylindrical aperture 203 turns and slides over the outer cylindrical surface of crankshaft 200; and, roller 205 moves downwardly along slot in the direction of arrow 216 to the position shown in FIG. 41.

In the embodiment of the invention shown in FIG. 42, the roller 205 and housing 219 have been replaced by a linkage arm 221. One end of arm 221 is pivotally attached to pin 206. The other end of arm 221 is pivotally attached to pin 207. Arm 221 pivots in the direction indicated by arrows 230 during operation of the engine apparatus of FIG. 42. Pin 207 can be maintained in a fixed position during operation of the apparatus of FIG. 42 or can, prior to or during operation of the apparatus, be adjusted in any desired direction, for example (and not by way of limitation), in the directions indicated by arrows 222, 223, 224, and 225. The member 233—screw 232—sleeve 231 apparatus earlier described can be used to laterally displace pin 207 in the direction of arrows 222 and 223. Pin 207 is fixedly attached to member 244. Member 244 is secured to member 233.

As would be appreciated by those of skill in the art, the embodiments of the invention illustrated in FIGS. 39 to 42 can, like other embodiments of invention earlier described herein, be utilized to alter the compression ratio of an engine, to alter—at points between TDC and BDC—the speed of travel of piston 212 in comparison to the normal speed of travel of the piston as typically represented by a bell curve, and to alter the points during one crankshaft revolution at which constant volume is achieved.

Having described my invention in such terms as to enable those skilled in the art to understand and practice it, and having identified the presently preferred embodiments thereof, I claim:

1. In combination with a reciprocating piston apparatus, said apparatus including a cylinder;

a piston positioned in and operatively associated with said cylinder to define a combustion chamber and to reciprocate through a plurality of positions in said cylinder, said combustion chamber (i) having a specific shape, dimension, and volume for each of said plurality of positions of said piston in said cylinder, and (ii) having a volume which continuously changes when said piston reciprocates in said cylinder;

a crankshaft; and, a conecting rod including a first end connected to said piston and a second end connected to said crankshaft, said crankshaft moving said piston and said connecting rod between a distal substantially motionless position and a proximate substantially motionless position such that said piston reciprocates in said cylinder in two opposing directions of travel and through said plurality of positions;

the improvements comprising constant volume means interconnecting said second end of said connecting rod and said crankshaft to alter said specific shape, dimension, and volume of said combustion chamber when said piston is in a selected position intermediate said distal position and said proximate position, said constant volume means momentarily halting the travel of said piston in said selected position such that the volume of said combustion chamber remains constant while said crankshaft rotates.

2. In combination with a reciprocating piston apparatus, said apparatus including a cylinder;

a piston positioned in and operatively associated with said cylinder to define a combustion chamber and to reciprocate through a plurality of positions in said cylinder, said combustion chamber (i) having a specific shape, dimension, and volume for each of said plurality of positions of said piston in said cylinder, and (ii) having a volume which continuously changes when said piston reciprocates in said cylinder;

a crankshaft having a centerline; and, a connecting rod including a first end connected to said piston and a second end connected to said crankshaft, said crankshaft moving said piston and said connecting rod between a distal substantially motionless position and a proximate substantially motionless position such that said piston reciprocates in said cylinder in two opposing directions of travel and through said plurality of positions, said plurality of positions of said piston during said reciprocation in said cylinder is generally represented by a sine wave, and, said piston moving at a selected ordinary speed of travel at each of said positions when said crankshaft rotates at a selected rpm;

the improvements comprising volume adjustment means interconnecting said second end of said connecting rod and said crankshaft, said volume adjustment means, when said piston is in a selected one of said plurality of positions intermediate said distal position and said proximate position, altering said selected ordinary speed of travel associated with said selected one of said plurality of positions.

3. The apparatus of claim 2 wherein (a) said volume adjustment means includes an arm (201) having (i) a proximate eccentric end (227) pivotally connected to said crankshaft, and (ii) a distal end which, during the rotation of said crankshaft, moves along a selected path to cause said arm to pivot about said crankshaft; and, (b) said second end of said connecting rod is pivotally connected to said proximate eccentric end such that when said arm pivots about said crankshaft, said second end is laterally displaced with respect to said centerline of said crankshaft.

4. The apparatus of claim 1 wherein (a) said constant volume means includes an arm (201) having (i) a proximate eccentric end (227) pivotally connected to said crankshaft, and (ii) a distal end which, during the rotation of said crankshaft, moves along a selected path to cause said arm to pivot about said crankshaft; and, (b) said second end of said connecting rod is pivotally connected to said proximate eccentric end such that when said arm pivots about said crankshaft, said second end is laterally displaced with respect to said centerline of said crankshaft.

* * * * *